US009488938B2

(12) United States Patent
Tamaki et al.

(10) Patent No.: US 9,488,938 B2
(45) Date of Patent: Nov. 8, 2016

(54) HEATER AND IMAGE HEATING APPARATUS INCLUDING THE SAME

(71) Applicant: CANON KABUSHIKI KAISHA, Tokyo (JP)

(72) Inventors: Masayuki Tamaki, Abiko (JP); Toshinori Nakayama, Kashiwa (JP); Shigeaki Takada, Abiko (JP); Naoki Akiyama, Toride (JP); Akeshi Asaka, Kashiwa (JP); Koichi Kakubari, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/799,056

(22) Filed: Jul. 14, 2015

(65) Prior Publication Data

US 2016/0026124 A1 Jan. 28, 2016

(30) Foreign Application Priority Data

Jul. 24, 2014 (JP) ..... 2014-150779

(51) Int. Cl.

*G03G 15/20* (2006.01)
*H05B 1/02* (2006.01)
*H05B 3/22* (2006.01)

(52) U.S. Cl.

CPC ..... *G03G 15/2017* (2013.01); *G03G 15/2042* (2013.01); *G03G 15/2053* (2013.01); *H05B 1/0241* (2013.01); *H05B 3/22* (2013.01); *G03G 2215/2035* (2013.01)

(58) Field of Classification Search

CPC ..... G03G 15/80; G03G 15/2042; G03G 15/2053; G03G 15/2082; H01C 17/06; H01C 17/28; H01C 17/283; H05B 1/0241; H05B 3/20; H05B 3/24

See application file for complete search history.

(56) References Cited

U.S. PATENT DOCUMENTS 5,285,049 A 2/1994 Fukumoto et al.
7,200,354 B2 4/2007 Nakamoto et al.

(Continued)

FOREIGN PATENT DOCUMENTS

EP 2 711 778 A2 3/2014
JP 5-29066 A 2/1993

(Continued)

OTHER PUBLICATIONS

European Search Report mailed Dec. 16, 2015 in European Patent Application No. 15176480.0.

(Continued)

*Primary Examiner* — Erika J Villaluna
(74) *Attorney, Agent, or Firm* — Fitzpatrick, Cella, Harper & Scinto

(57) ABSTRACT

A heater includes: a substrate; a first electrical contact; a plurality of second electrical contacts; an electroconductive line portion electrically connected with the first electrical contact; a plurality of electrode portions including first electrode portions electrically connected with the first electrical contact through the electroconductive line portion and second electrode portions electrically connected with the second electrical contacts; and a plurality of heat generating portions provided between adjacent ones of the electrode portions. The cross-section of the electroconductive line portion in a side closer to the first electrical contact than the plurality of heat generating portions with respect to the longitudinal direction is larger than the cross-section of a predetermined electrode portion, between adjacent heat generating portions, of the plurality of electrode portions.

23 Claims, 11 Drawing Sheets

(56) References Cited

U.S. PATENT DOCUMENTS

| | | | |
|---|---|---|---|
| 7,260,351 | B2 | 8/2007 | Nakayama |
| 7,263,303 | B2 | 8/2007 | Nakayama |
| 7,343,130 | B2 | 3/2008 | Nakayama |
| 7,430,392 | B2 | 9/2008 | Ito et al. |
| 7,457,576 | B2 | 11/2008 | Takada et al. |
| 7,460,821 | B2 | 12/2008 | Ai et al. |
| 7,466,950 | B2 | 12/2008 | Matsuura et al. |
| 7,505,724 | B2 | 3/2009 | Nakayama |
| 7,590,366 | B2 | 9/2009 | Nakayama |
| 7,596,348 | B2 | 9/2009 | Nakamoto et al. |
| 7,729,628 | B2 | 6/2010 | Nakayama |
| 7,844,208 | B2 | 11/2010 | Hayashi et al. |
| 7,907,861 | B2 | 3/2011 | Nakayama |
| 8,145,086 | B2 | 3/2012 | Chiyoda et al. |
| 8,301,067 | B2 | 10/2012 | Takada |
| 8,306,446 | B2 | 11/2012 | Ito et al. |
| 8,559,837 | B2 | 10/2013 | Nakayama |
| 8,712,271 | B2 | 4/2014 | Nakayama et al. |
| 8,750,739 | B2 | 6/2014 | Tamaki et al. |
| 8,818,222 | B2 | 8/2014 | Tamaki |
| 8,867,941 | B2 | 10/2014 | Takada |
| 8,913,936 | B2 | 12/2014 | Takada et al. |
| 8,917,999 | B2 | 12/2014 | Takada et al. |
| 8,918,003 | B2 | 12/2014 | Kawai et al. |
| 8,929,762 | B2 | 1/2015 | Shinagawa et al. |
| 8,989,640 | B2 | 3/2015 | Kitagawa et al. |
| 2011/0082260 | A1 | 4/2011 | Omata et al. |
| 2012/0076521 | A1 | 3/2012 | Ishihara et al. |
| 2012/0224876 | A1 | 9/2012 | Nakayama et al. |
| 2013/0142532 | A1 | 6/2013 | Kitagawa et al. |
| 2013/0206745 | A1 | 8/2013 | Tanaka et al. |
| 2013/0299480 | A1 | 11/2013 | Kakubari et al. |
| 2013/0322897 | A1 | 12/2013 | Yago et al. |
| 2014/0076878 | A1* | 3/2014 | Shimura ..... G03G 15/2042 219/216 |
| 2014/0105658 | A1 | 4/2014 | Tamaki |
| 2014/0112692 | A1 | 4/2014 | Omata et al. |
| 2014/0353303 | A1 | 12/2014 | Fudo et al. |
| 2015/0212473 | A1 | 7/2015 | Kitagawa et al. |

FOREIGN PATENT DOCUMENTS

| | | | |
|---|---|---|---|
| JP | 8-55671 | A | 2/1996 |
| JP | 3284580 | B2 | 5/2002 |
| JP | 2012-37613 | A | 2/2012 |
| JP | 2014-235315 | A | 12/2014 |
| WO | 2012 120867 | A1 | 9/2012 |

OTHER PUBLICATIONS

U.S. Appl. No. 14/718,557, dated May 21, 2015.
U.S. Appl. No. 14/718,672, dated May 21, 2015.
U.S. Appl. No. 14/719,497, dated May 22, 2015.
U.S. Appl. No. 14/719,474, dated May 22, 2015.
U.S. Appl. No. 14/794,869, dated Jul. 9, 2015.
U.S. Appl. No. 14/799,123, dated Jul. 14, 2015.
U.S. Appl. No. 14/844,249, dated Sep. 3, 2015.
U.S. Appl. No. 14/857,086, dated Sep. 17, 2015.

* cited by examiner

HEATER AND IMAGE HEATING APPARATUS INCLUDING THE SAME

FIELD OF THE INVENTION AND RELATED ART

The present invention relates to a heater for heating an image on a sheet and an image heating apparatus provided with the same. The image heating apparatus is usable with an image forming apparatus such as a copying machine, a printer, a facsimile machine, a multifunction machine having a plurality of functions thereof or the like.

An image forming apparatus is known in which a toner image is formed on the sheet and is fixed on the sheet by heat and pressure in a fixing device (image heating apparatus). As for such a fixing device, a type of fixing device is proposed (Japanese Laid-open Patent Application 2012-37613) in which a heat generating element (heater) contacts an inner surface of a thin flexible belt to apply heat to the belt. Such a fixing device is advantageous in that the structure has a low thermal capacity, and therefore, the temperature rise to render the fixing operation effective is quick.

Japanese Laid-open Patent Application 2012-37613 discloses a structure of a fixing device in which a heat-generating-region width of the heat generating element (heater) is controlled in accordance with the width size of the sheet. In FIG. 12, (*a*) and (*b*) are circuit diagrams of the fixing device disclosed in Japanese Laid-Open Patent Application 2012-37613. As shown in FIG. 12, the fixing device comprises electrodes 1027 (1027*a*-1027*f*) arranged in a longitudinal direction of a substrate 1021 and heat generating resistance layers (1025), and the electric power is supplied through the electrodes to the heat generating resistance layers 1025 (1025*a*-1025*e*) so that the heat generating resistance layer generates heat.

In this fixing device, each electrode is electrically connected with an electroconductive line layer 1029 (1029*a*, 1029*b*) formed on the substrate. More specifically, the electroconductive line layer is connected with the electrode 1027*b* and the electrode 1027*d* extends toward one longitudinal end of the substrate. The electroconductive line layer 1029*a* is connected with the electrode 1027*c* and the electrode 1027*e* extends toward another longitudinal end of the substrate. In the one end portion of the substrate with respect to the longitudinal direction, the electrode 1027*a* and the electroconductive line layer 1029*b* are connectable with respective electroconductive members. In the other end portion of the substrate with respect to the longitudinal direction, the electrode 1027*f* and the electroconductive line layer 1029*a* are connectable with respective electroconductive members. More specifically, the opposite longitudinal end portions of the substrate are not coated with an insulation layer for protecting the electroconductive lines, and the electroconductive line layers 1029*a* 1029*b* and the electrodes 1027*a*, 1027*f* are exposed. For that reason, the electroconductive member contacts the exposed portions of the electroconductive line layers 1029*a* and 1029*b* and the exposed portions of the electrodes 1027*a* and 1027*f*, so that the heat generating element 1006 is connected with a voltage supply circuit. The voltage supply circuit includes an AC voltage source and switches 1033 (1033*a*, 1033*b*, 1033*c*, 1033*d*), by combinations of the actuations of which the heater energization pattern is controlled. In other words, the electroconductive line layers 1029*a*, 1029*b* are selectively connected with a voltage source contact 1031*a* or a voltage source contact 1031*b* in accordance with the intended connection pattern. With such a structure, the fixing device disclosed in Japanese Laid-open Patent Application 2012-37613 changes the width size of the heat generating region of the heat generating resistance layer 1025 in accordance with the width size of the sheet to be heated thereby. That is, the fixing device has a constitution in which heat generation of the heat generating element in a region where the sheet does not pass is suppressed, and therefore the an amount of unnecessary heat generation for fixation is small and thus energy (electric power) efficiency is excellent.

However, the heat generating element 1006 disclosed in Japanese Laid-Open Patent Application 2012-37613 is susceptible to further improvement in terms of electric power efficiency. This is because as described in Japanese Laid-Open Patent Application 2012-37613, the heat generating element 1006 including the electroconductive line on the substrate consumes a part of electric power, as Joule heat in the electroconductive line 1029, to be supplied to the heat generating line 1025. Here, electroconductive line 1029*b* extends toward an outside of the substrate more than the heat generation line 1025*a* with respect to the longitudinal direction of the substrate. Of the heat generating element 1006, a longitudinal outside portion of the substrate more than the heat generating line 1025*a* is not a region used for a fixing process, and therefore in this region, the heat generation of the electroconductive line 1029*b* does not contribute to the fixing process. For that reason, the electroconductive line 1029*b* caused waste of the electric power.

For that reason, a heat generating element capable of suppressing electric power consumption of the heat generating line in a longitudinal direction outside of the heat generation line is desired.

SUMMARY OF THE INVENTION

Accordingly, it is an object of the present invention to provide a heater with suppressed electric power consumption.

It is another object of the present invention to provide an image heating apparatus with suppressed electric power consumption.

According to an aspect of the present invention, there is provided a heater usable with an image heating apparatus including an electric energy supplying portion provided with a first terminal and a second terminal, and an endless belt for heating an image on a sheet. The heater is contactable to the belt to heat the belt. The heater comprises: a substrate; a first electrical contact provided on the substrate and electrically connectable with the first terminal; a plurality of second electrical contacts provided on the substrate and electrically connectable with the second terminal; and an electroconductive line portion electrically connected with the first electrical contact. The electroconductive line portion extends in a longitudinal direction of the substrate. The heater also comprises: a substrate; and a plurality of electrode portions including a first electrode portion electrically connected with the first electrical contact through the electroconductive line portion and second electrode portions electrically connected with the second electrical contacts. The first electrode portions and the second electrode portions are arranged alternately with predetermined gaps in a longitudinal direction of the substrate. The heater further comprises a plurality of heat generating portions provided between adjacent ones of the electrode portions so as to electrically connect between adjacent electrode portions, the heat generating portions being capable of generating heat by electric power supply between adjacent electrode portions. A cross-section of the electroconductive line portion in a side closer to the first electrical contact than the plurality of heat generating portions are with respect to the longitudinal direction is larger than a cross-section of a predetermined electrode portion, between adjacent heat generating portions, of the plurality of electrode portions.

Further features of the present invention will become apparent from the following description of exemplary embodiments with reference to the attached drawings.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called printer.

[Embodiment 1]

[Image Forming Portion]

Figure 1:
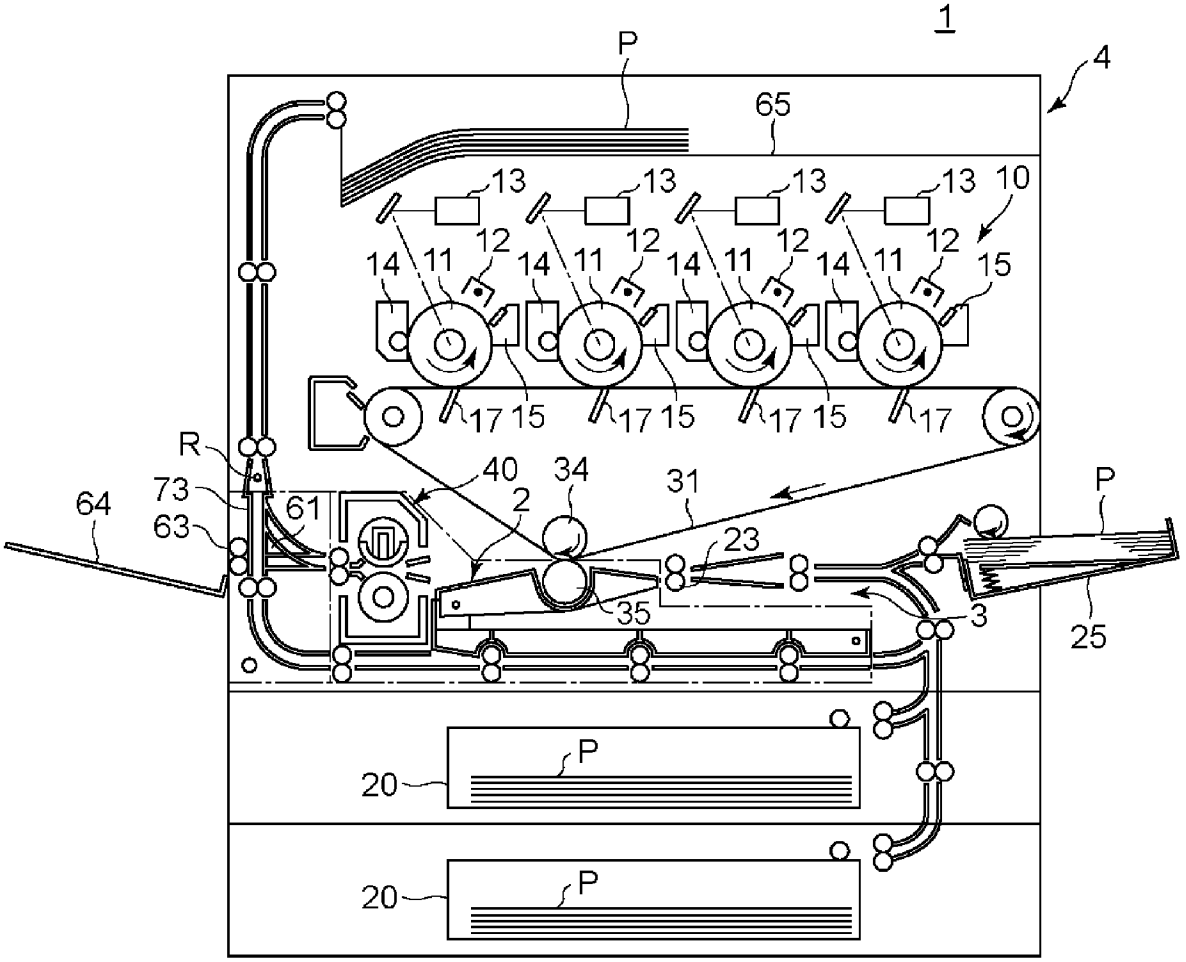
FIG. 1 is a sectional view of an image forming apparatus according to Embodiment 1 of the present invention.

FIG. 1 is a sectional view of the printer 1 which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on the sheet P. Referring to FIG. 1, the structure of the apparatus will be described in detail.

As shown in FIG. 1, the printer 1 includes image forming stations 10 for forming respective color toner images Y (yellow), M (magenta), C (cyan) and Bk (black). The image forming stations 10 includes respective photosensitive drums 11 corresponding to Y, M, C, Bk colors are arranged in the order named from the left side. Around each drum 11, similar elements are provided as follows: a charger 12; an exposure device 13; a developing device 14; a primary transfer blade 17; and a cleaner 15. The structure for the Bk toner image formation will be described as a representative, and the descriptions for the other colors are omitted for simplicity by assigning the like reference numerals. So, the elements will be simply called the photosensitive drum 11, the charger 12, the exposure device 13, the developing device 14, the primary transfer blade 17 and the cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17 and the cleaner 15 are provided in the order named.

A surface of the photosensitive drum 11 is electrically charged by the charger 12. Thereafter, the surface of the photosensitive drum 11 exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation.

On the other hand, the sheet P contained in a feeding cassette 20 or placed on a multi-feeding tray 25 is picked up by a feeding mechanism (unshown) and fed to a pair of registration rollers 23. The sheet P is a member on which the image is formed. Specific examples of the sheet P is plain paper, a thick sheet, a resin material sheet, an overhead projector film or the like. The pair of registration rollers 23 once stops the sheet P for correcting oblique feeding. The registration rollers 23 then feed the sheet P into between the intermediary transfer belt 31 and the secondary transfer roller 35 in timed relation with the toner image on the intermediary transfer belt 31. The roller 35 functions to transfer the color toner images from the belt 31 onto the sheet P. Thereafter, the sheet P is fed into the fixing device (image heating apparatus) 40. The fixing device 40 applies heat and pressure to the toner image T on the sheet P to fix the toner image on the sheet P.

[Fixing Device]

Figure 2:
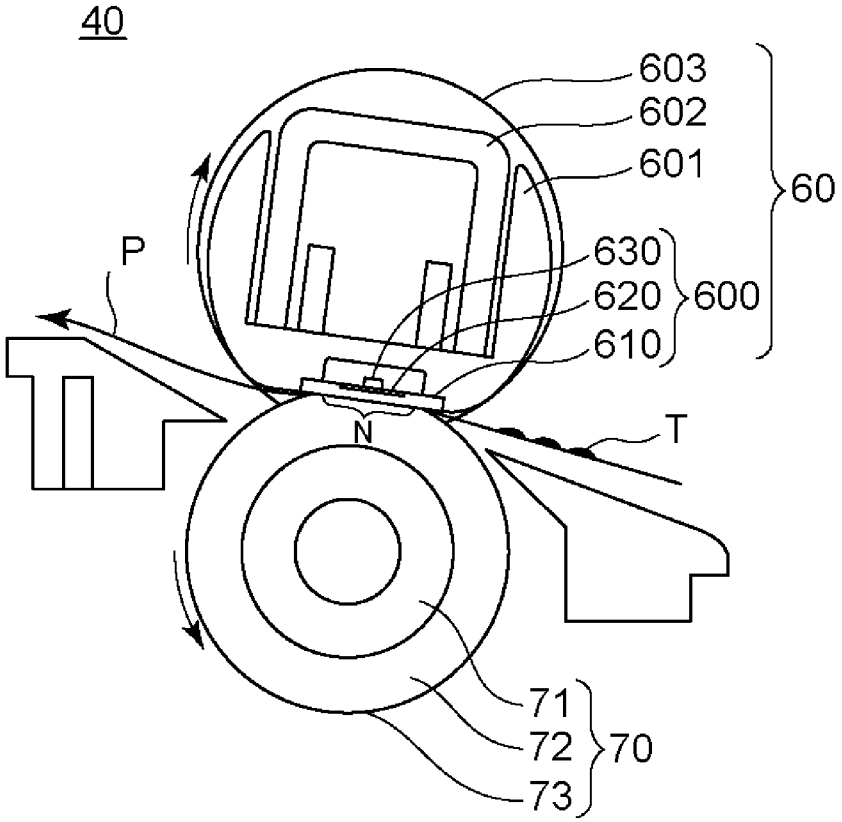
FIG. 2 is a sectional view of an image heating apparatus according to Embodiment 1 of the present invention.
Figure 3:
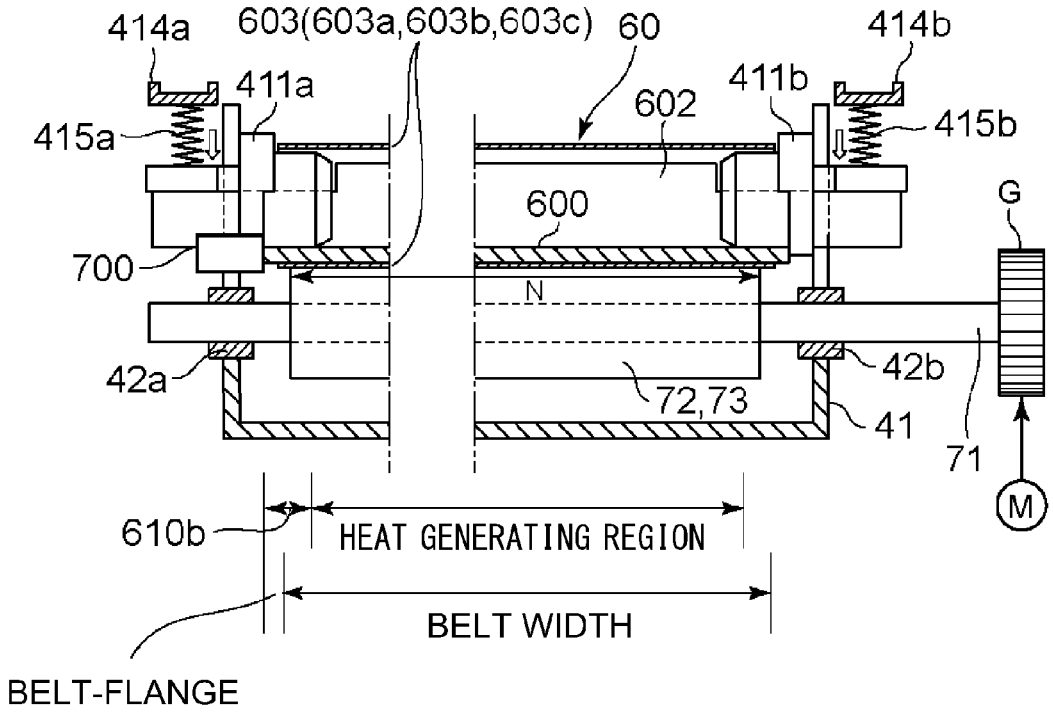
FIG. 3 is a front view of the image heating apparatus according to Embodiment 1 of the present invention.
Figure 4:
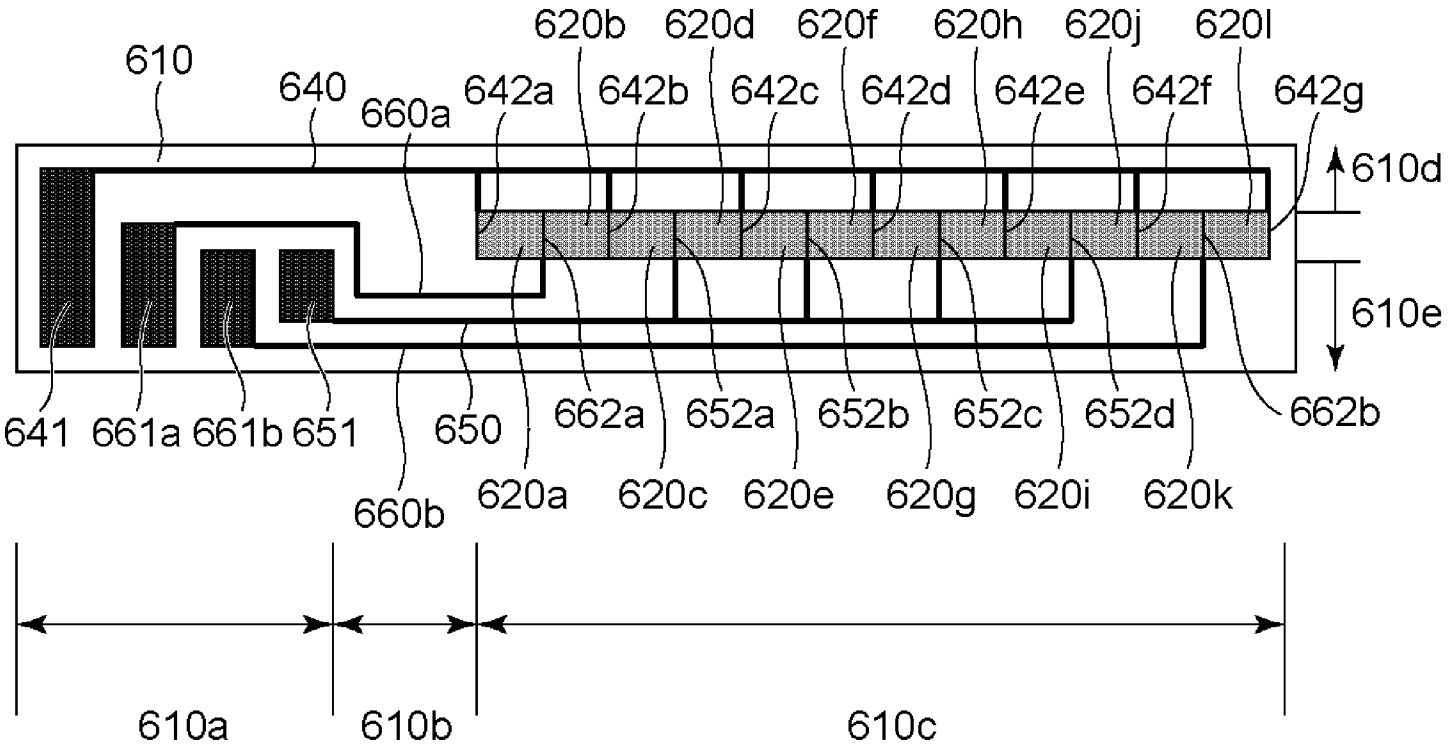
FIG. 4 illustrates a structure of a heater Embodiment 1.
Figure 5:
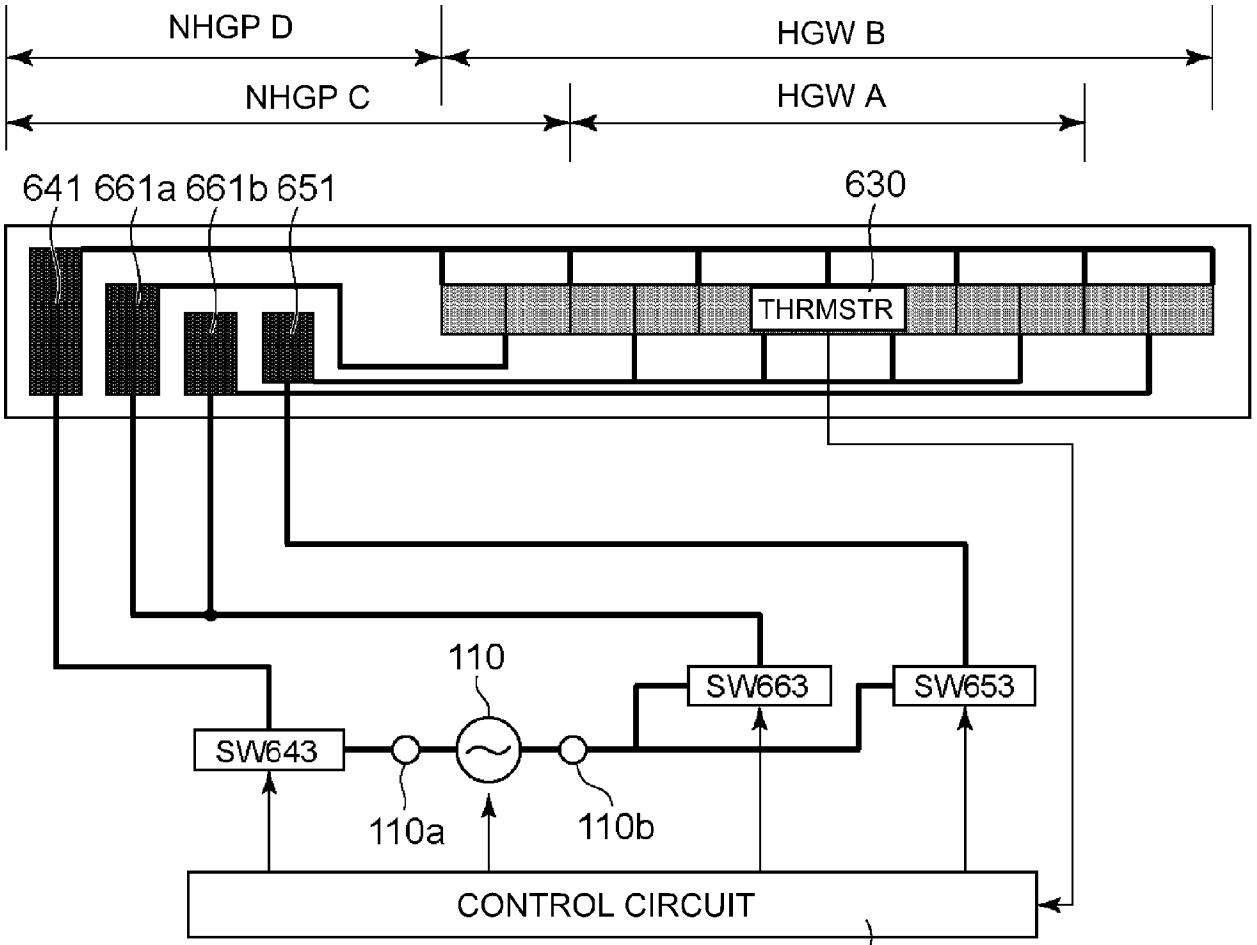
FIG. 5 illustrates the structural relationship of the image heating apparatus according to Embodiment 1.

The fixing device 40 which is the image heating apparatus used in the printer 1 will be described. FIG. 2 is a sectional view of the fixing device 40. FIG. 3 is a front view of the fixing device 40. FIG. 4 illustrates a structure of a heater 600. FIG. 5 illustrates a structural relationship of the fixing device 40.

The fixing device 40 is an image heating apparatus for heating the image on the sheet by a heater unit 60 (unit 60). The unit 60 includes a flexible thin fixing belt 603 and the heater 600 contacting the inner surface of the belt 603 to heat the belt 603 (low thermal capacity structure). Therefore, the belt 603 can be efficiently heated, so that a quick temperature rise at the start of the fixing operation is accomplished. As shown in FIG. 2, the belt 603 is nipped between the heater 600 and the pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) to nip and feed the sheet P supplied to the nip N. At this time, the heat from the heater 600 is supplied to the sheet P through the belt 603, and therefore, the toner image T on the sheet P is heated and pressed by the nip N, so that the toner image it fixed on the sheet P by the heat and pressure. The sheet P having passed through the fixing nip N is separated from the belt 603 and is discharged. In this embodiment, the fixing process is carried out as described above. The structure of the fixing device 40 will be described in detail.

Unit 60 is a unit for heating and pressing an image on the sheet P. A longitudinal direction of the unit 60 is parallel with the longitudinal direction of the roller 70. The unit 60 comprises a heater 600, a heater holder 601, a support stay 602 and a belt 603.

The heater 600 is a heating member for heating the belt 603, slidably contacting the inner surface of the belt 603. The heater 600 is pressed to the inside surface of the belt 603 toward the roller 70 so as to provide a desired nip width of the nip N. The dimensions of the heater 600 in this embodiment are 5-20 mm in the width (the dimension as measured in the up-down direction in FIG. 4), 350-400 mm in the length (the dimension measured in the left-right direction in FIG. 4), and 0.5-2 mm in the thickness. The heater 600 comprises a substrate 610 elongated in a direction perpendicular to the feeding direction of the sheet P (widthwise direction of the sheet P), and a heat generating resistor 620 (heat generating element 620).

The heater 600 is fixed on the lower surface of the heater holder 601 along the longitudinal direction of the heater holder 601. In this embodiment, the heat generating element 620 is provided on the back side of the substrate 610, is not in slidable contact with the belt 603, but the heat generating element 620 may be provided on the front surface of the substrate 610, is in slidable contact with the belt 603. However, the heat generating element 620 of the heater 600 is preferably provided on the back side of the substrate 610, by which a uniform heating effect to the substrate 610 is accomplished, from the standpoint of preventing the non-uniform heat application to the belt 603. The details of the heater 600 will be described hereinafter.

The belt 603 is a cylindrical (endless) belt (film) for heating the image on the sheet in the nip N. The belt 603 comprises a base material 603*a*, an elastic layer 603*b* thereon, and a parting layer 603*c* on the elastic layer 603*b*, for example. The base material 603*a* may be made of metal material, such as stainless steel or nickel, or a heat resistive resin material, such as polyimide. The elastic layer 603*b* may be made of an elastic and heat resistive material, such as a silicone rubber or a fluorine-containing rubber. The parting layer 603*c* may be made of fluorinated resin material or silicone resin material.

The belt 603 of this embodiment has dimensions of 30 mm in the outer diameter, 330 mm in the length (the dimension measured in the front-rear direction in FIG. 2), 30 μm in the thickness, and the material of the base material 603*a* is nickel. The silicone rubber elastic layer 603*b* having a thickness of 400 μm is formed on the base material 603*a*, and a fluorine resin tube (parting layer 603*c*) having a thickness of 20 μm coats the elastic layer 603*b*.

The belt contacting surface of the substrate 610 may be provided with a polyimide layer having a thickness of 10 μm as a sliding layer 603*d*. When the polyimide layer is provided, the rubbing resistance between the fixing belt 603 and the heater 600 is low, and therefore, the wearing of the inner surface of the belt 603 can be suppressed. In order to further enhance slidability, a lubricant, such as grease, may be applied to the inner surface of the belt.

The heater holder 601 (holder 601) functions to hold the heater 600 in the state of urging the heater 600 toward the inner surface of the belt 603. The holder 601 has a semi-arcuate cross-section (the surface of FIG. 2) and functions to regulate the rotation orbit of the belt 603. The holder 601 may be made of heat resistive resin material or the like. In this embodiment, it is Zenite 7755 (tradename) available from Dupont.

The support stay 602 supports the heater 600 by way of the holder 601. The support stay 602 is preferably made of a material which is not easily deformed even when a high pressure is applied thereto, and in this embodiment, it is made of SUS304 (stainless steel).

As shown in FIG. 3, the support stay 602 is supported by left and right flanges 411*a* and 411*b* at the opposite end portions with respect to the longitudinal direction. The flanges 411*a* and 411*b* may be simply called flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between a flange 411*b* and a pressing arm 414*b*, an urging spring 415*b* is compressed. The urging springs 415*a* and 415*b* may be simply called an urging spring 415. With such a structure, an elastic force of the urging spring 415 is applied to the heater 600 through the flange 411 and the support stay 602. The belt 603 is pressed against the upper surface of the roller 70 at a predetermined urging force to form the nip N having a predetermined nip width. In this embodiment, the pressure is 156.8 N (16 kgf) at one end portion side and 313.6 N (32 kgf) in total.

As shown in FIG. 3, a connector 700 is provided as an electric energy supply portion electrically connected with the heater 600 to supply the electric power to the heater 600. The connector 700 is detachably provided at one longitudinal end portion of the heater 600. The connector 700 is easily detachably mounted to the heater 600, and therefore, assembling of the fixing device 40 and the exchange of the heater 600 or belt 603 upon damage of the heater 600 is easy, thus providing a good maintenance property. Details of the connector 700 will be described hereinafter.

As shown in FIG. 2, the roller 70 is a nip forming member which contacts an outer surface of the belt 603 to cooperate with the belt 603 to form the nip N. The roller 70 has a multi-layer structure on a metal core 71 of metal material, the multi-layer structure including an elastic layer 72 on the metal core 71 and a parting layer 73 on the elastic layer 72. Examples of the materials of the metal core 71 include SUS (stainless steel), SUM (sulfur and sulfur-containing free-machining steel), Al (aluminum) or the like. Examples of the materials of the elastic layer 72 include an elastic solid rubber layer, an elastic foam rubber layer, an elastic porous rubber layer or the like. Examples of the materials of the parting layer 73 include fluorinated resin material.

The roller 70 of this embodiment includes a metal core 1 71 of steel, an elastic layer 72 of silicone rubber foam on the metal core 71, and a parting layer 73 of fluorine resin tube on the elastic layer 72. The dimensions of the portion of the roller 70 having the elastic layer 72 and the parting layer 73 are 25 mm in outer diameter, and 330 mm in length.

A themistor 630 is a temperature sensor provided on a back side of the heater 600 (opposite side from the sliding surface side. The themistor 630 is bonded to the heater 600 in the state that it is insulated from the heat generating element 620. The themistor 630 has a function of detecting a temperature of the heater 600. As shown in FIG. 5, the themistor 630 is connected with a control circuit 100 through an A/D converter (unshown) and feed an output corresponding to the detected temperature to the control circuit 100.

The control circuit 100 comprises a circuit including a CPU operating for various controls, and a non-volatilization medium such as a ROM storing various programs. The programs are stored in the ROM, and the CPU reads and execute them to effect the various controls. The control circuit 100 may be an integrated circuit such as ASIC if it is capable of performing the similar operation.

As shown in FIG. 5, the control circuit 100 is electrically connected with the voltage source 110 so as to control electric power supply from the voltage source 110. The control circuit 100 is electrically connected with the themistor 630 to receive the output of the themistor 630.

The control circuit 100 uses the temperature information acquired from the thermistor 630 for the electric power supply control for the voltage source 110. More particularly, the control circuit 100 controls the electric power to the heater 600 through the voltage source 110 on the basis of the output of the themistor 630. In this embodiment, the control circuit 100 carries out a wave number control of the output of the voltage source 110 to adjust the amount of heat generation of the heater 600. By such a control, the heater 600 is maintained at a predetermined temperature (180 degree C., for example).

As shown in FIG. 3, the metal core 71 of the roller 70 is rotatably held by bearings 41*a* and 41*b* provided in a rear side and a front side of the side plate 41, respectively. One axial end of the metal core 71 is provided with a gear G to transmit the driving force from a motor M to the metal core 71 of the roller 70. As shown in FIG. 2, the roller 70 receiving the driving force from the motor M rotates in the direction indicated by the arrow (clockwise direction). In the nip N, the driving force is transmitted to the belt 603 by the way of the roller 70, so that the belt 603 is rotated in the direction indicated by the arrow (counterclockwise direction).

The motor M is a driving means for driving the roller 70 through the gear G. The control circuit 100 is electrically connected with the motor M to control the electric power supply to the motor M. When the electric energy is supplied by the control of the control circuit 100, the motor M starts to rotate the gear G.

The control circuit 100 controls the rotation of the motor M. The control circuit 100 rotates the roller 70 and the belt 603 using the motor M at a predetermined speed. It controls the motor so that the speed of the sheet P nipped and fed by the nip N in the fixing process operation is the same as a predetermined process speed (200 [mm/sec], for example).

[Heater]

Figure 6:
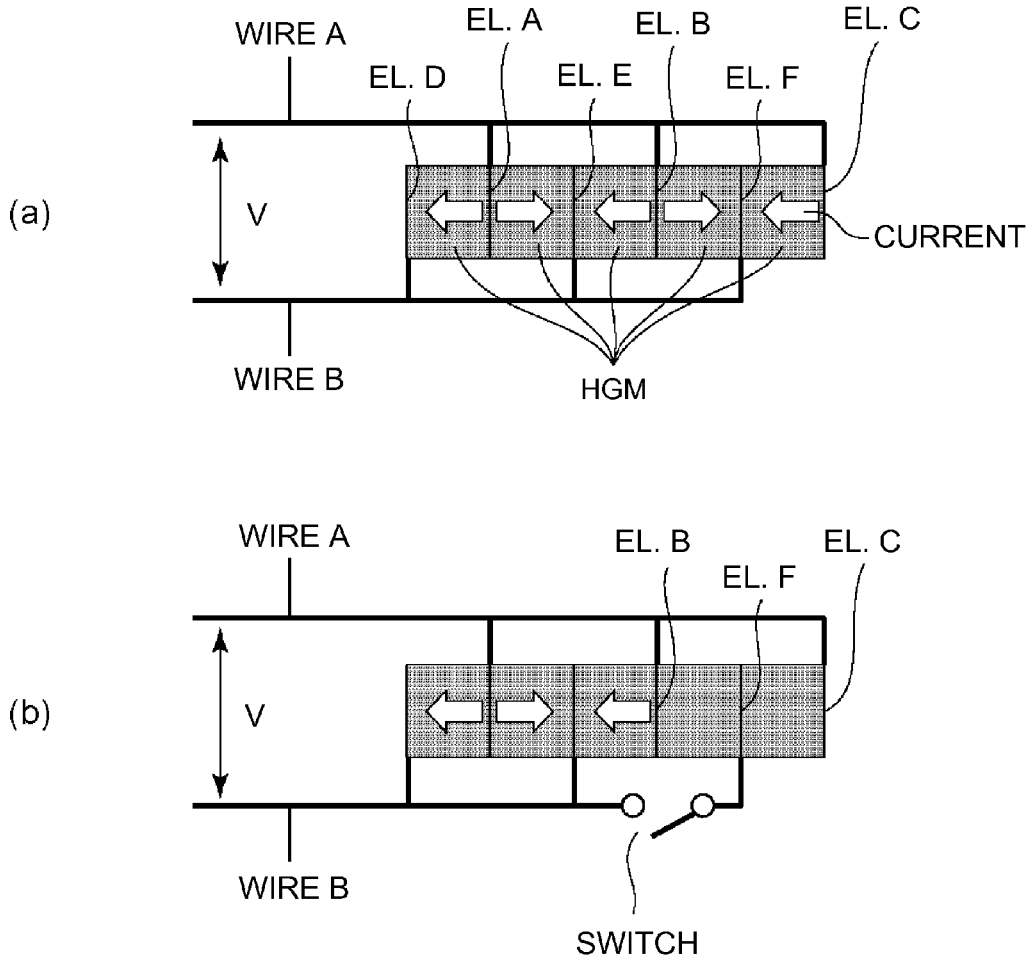
In FIG. 6, (*a*) illustrates a heat generating type for a heater, and (*b*) illustrates a switching system for a heat generating region of the heater.
Figure 8:
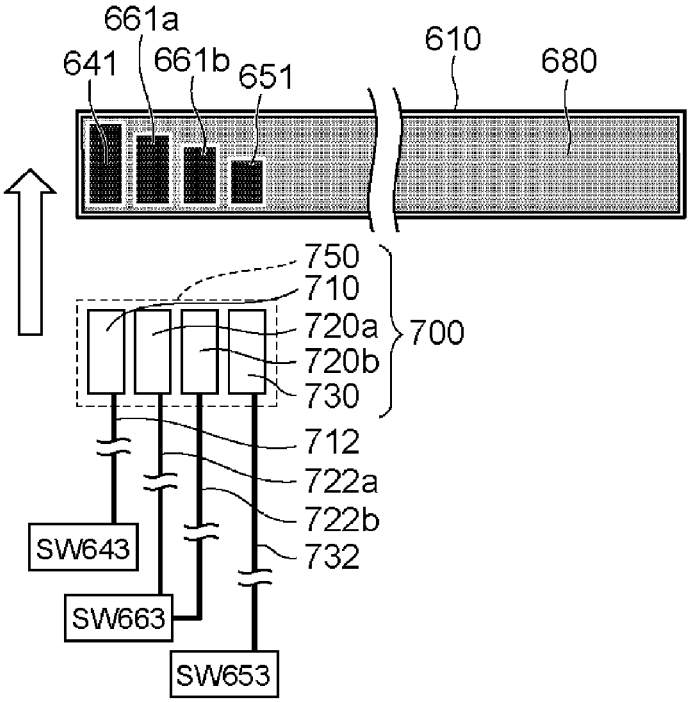
FIG. 8 illustrates a connector.

The structure of the heater 600 used in the fixing device 40 will be described in detail. In FIG. 6, (*a*) illustrates a heat generating type used in the heater 600, and (*b*) illustrates a heat generating region switching type used with the heater 600. FIG. 8 illustrates a connector 700.

The heater 600 of this embodiment is a heater using the heat generating type shown in (*a*) and (*b*) of FIG. 16. As shown in (*a*) of FIG. 6, electrodes A-C are electrically connected with A-electroconductive-line ("WIRE A"), and electrodes D-F are electrically connected with B-electroconductive-line ("WIRE B"). The electrodes connected with the A-electroconductive-lines and the electrodes connected with the B-electroconductive-lines are interlaced (alternately arranged) along the longitudinal direction (left-right direction in (*a*) of FIG. 6), and heat generating elements are electrically connected between the adjacent electrodes. The electrodes and the electroconductive lines are electroconductive patterns (lead wires) formed in a similar manner. In this embodiment, the lead wire contacted to and electrically connected with the heat generating element is referred to as the electrode, and the lead wire performing the function of connecting a portion, to which the voltage is applied, with the electrode is referred to as the electroconductive line (electric power supplying line). When a voltage V is applied between the A-electroconductive-line and the B-electroconductive-line, a potential difference is generated between the adjacent electrodes. As a result, electric currents flow through the heat generating elements, and the directions of the electric currents through the adjacent heat generating elements are opposite to each other. In this type heater, the heat is generated in the above-described the manner. As shown in (*b*) of FIG. 6, between the B-electroconductive-line and the electrode F, a switch or the like is provided, and when the switch is opened, the electrode B and the electrode C are at the same potential, and therefore, no electric current flows through the heat generating element therebetween. In this system, the heat generating elements arranged in the longitudinal direction are independently energized so that only a part of the heat generating elements can be energized by switching a part off. In other words, in the system, the heat generating region can be changed by providing switch or the like in the electroconductive line. In the heater 600, the heat generating region of the heat generating element 620 can be changed using the above-described system.

The heat generating element generates heat when energized, irrespective of the direction of the electric current, but it is preferable that the heat generating elements and the electrodes are arranged so that the currents flow along the longitudinal direction. Such an arrangement is advantageous over the arrangement in which the directions of the electric currents are in the widthwise direction perpendicular to the longitudinal direction (up-down direction in (*a*) of FIG. 6) in the following point. When joule heat generation is effected by the electric energization of the heat generating element, the heat generating element generates heat correspondingly to the resistance value thereof, and therefore, the dimension and the material of the heat generating element are selected in accordance with the direction of the electric current so that the resistance value is at a desired level. The dimension of the substrate on which the heat generating element is provided is very short in the widthwise direction as compared with that in the longitudinal direction. Therefore, if the electric current flows in the widthwise direction, it is difficult to provide the heat generating element with a desired resistance value, using a low resistance material. On the other hand, when the electric current flows in the longitudinal direction, it is relatively easy to provide the heat generating element with a desired resistance value, using the low resistance material. In addition, when a high resistance material is used for the heat generating element, a temperature non-uniformity may result from non-uniformity in the thickness of the heat generating element when it is energized. For example, when the heat generating element material is applied on the substrate along the longitudinal direction by screen printing or like, a thickness non-uniformity of about 5% may result in the widthwise direction. This is because a heat generating element material painting non-uniformity occurs due to a small pressure difference in the widthwise direction by a painting blade. For this reason, it is preferable that the heat generating elements and the electrodes are arranged so that the electric currents flow in the longitudinal direction.

In the case that the electric power is supplied individually to the heat generating elements arranged in the longitudinal direction, it is preferable that the electrodes and the heat generating elements are disposed such that the directions of the electric current flow alternates between adjacent ones. As to the arrangements of the heat generating members and the electrodes, it would be considered to arrange the heat generating elements each connected with the electrodes at the opposite ends thereof, in the longitudinal direction, and the electric power is supplied in the longitudinal direction. However, with such an arrangement, two electrodes are provided between adjacent heat generating elements, with the result of the likelihood of short circuit. In addition, the number of required electrodes is large with the result of large non-heat generating portion between the heat generating elements. Therefore, it is preferable to arrange the heat generating elements and the electrodes such that an electrode is made common between adjacent heat generating elements. With such an arrangement, the likelihood of the short circuit between the electrodes can be avoided, and a space between the electrodes can be eliminated.

In this embodiment, a common electroconductive line 640 shown in FIG. 4 corresponds to A-electroconductive-line of (*a*) of FIG. 6, and opposite electroconductive lines 650, 660*a*, 660*b* correspond to B-electroconductive-line. In addition, common electrodes 652*a*-652*g* correspond to electrodes A-C of (*a*) of FIG. 6, and opposite electrodes 652*a*-652*d*, 662*a*, 662*b* correspond to electrodes D-F. Heat generating elements 620*a*-620*l* correspond to the heat generating elements of (*a*) of FIG. 6. Hereinafter, the common electrodes 642*a*-642*g* are simply common electrode 642. The opposite electrodes 652*a*-652*d* are simply called opposite electrode 652. The opposite electrodes 662*a*, 662*b* are simply called opposite electrode 662. The opposite electroconductive lines 660*a*, 660*b* are simply called opposite electroconductive line 660. The heat generating elements 620*a*-620*l* are simply called heat generating element 620. The structure of the heater 600 will be described in detail referring to the accompanying drawings.

As shown in FIGS. 4 and 8, the heater 600 comprises the substrate 610, the heat generating element 620 on the substrate 610, an electroconductor pattern (electroconductive line), and an insulation coating layer 680 covering the heat generating element 620 and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride or the like, which has high heat resistivity, thermo-conductivity, electrical insulative property or the like. In this embodiment, the substrate is a plate member of alumina having a length (measured in the left-right direction in FIG. 4) of 400 mm, a width (up-down direction in FIG. 4) of 10 mm and a thickness of 1 mm. The alumina plate member is 30 W/m·K in thermal conductivity.

On the back side of the substrate 610, the heat generating element 620 and the electroconductor pattern (electroconductive line) are provided through thick film printing method (screen printing method) using an electroconductive thick film paste. In this embodiment, a silver paste is used for the electroconductor pattern so that the resistivity is low, and a silver—palladium alloy paste is used for the heat generating element 620 so that the resistivity is high. As shown in FIG. 8, the heat generating element 620 and the electroconductor pattern coated with the insulation coating layer 680 of heat resistive glass so that they are electrically protected from leakage and short circuit. For that reason, in this embodiment, a gap between adjacent electroconductive lines can be provided narrowly. However, the insulation coating layer 680 is not necessarily provided. For example, by providing the adjacent electroconductive lines with a large gap, it is possible to prevent short circuit between the adjacent electroconductive lines. However, it is desirable that a constitution in which the insulation coating layer 680 is provided from the viewpoint that the heater 600 can be downsized.

As shown in FIG. 4, there are provided electrical contacts 641, 651, 661*a*, 661*b* as a part of the electroconductor pattern in one end portion side of the substrate 610 with respect to the longitudinal direction. In addition, there are provided the heat generating element 620 common electrodes 642*a*-642*g* and opposite electrodes 652*a*-652*d*, 662*a*, 662*b* as a part of the electroconductor pattern in the other end portion side of the substrate 610 with respect to the longitudinal direction of the substrate 610. Between the one end portion side 610*a* of the substrate and the other end portion side 610*c*, there is a middle region 610*b*. In one end portion side 610*d* of substrate 610 beyond the heat generating element 620 with respect to the widthwise direction, the common electroconductive line 640 as a part of the electroconductor pattern is provided. In the other end portion side 610*e* of the substrate 610 beyond the heat generating element 620 with respect to the widthwise direction, the opposite electroconductive lines 650 and 660 are provided as a part of the electroconductor pattern.

The heat generating element 620 (620*a*-620*l*) is a resistor capable of generating joule heat by electric power supply (energization). The heat generating element 620 is one heat generating element member extending in the longitudinal direction on the substrate 610, and is disposed in the other end portion side 610*c* (FIG. 4) of the substrate 610. The heat generating element 620 has a desired resistance value, and has a width (measured in the widthwise direction of the substrate 610) of 1-4 mm, a thickness of 5-20 μm. The heat generating element 620 in this embodiment has the width of 2 mm and the thickness of 10 μm. A total length of the heat generating element 620 in the longitudinal direction is 320 mm, which is enough to cover a width of the A4 size sheet P (297 mm in width).

On the heat generating element 620, seven common electrodes 642*a*-642*g* which will be described hereinafter are laminated with intervals in the longitudinal direction. In other words, the heat generating element 620 is isolated into six sections by common electrodes 642*a*-642*g* along the longitudinal direction. The lengths measured in the longitudinal direction of the substrate 610 of each section are 53.3 mm. On central portions of the respective sections of the heat generating element 620, one of the six opposite electrodes 652, 662 (652*a*-652*d*, 662*a*, 662*b*) are laminated. In this manner, the heat generating element 620 is divided into 12 sub-sections. The heat generating element 620 divided into 12 sub-sections can be deemed as a plurality of heat generating elements 620*a*-620*l*. In other words, the heat generating elements 620*a*-620*l* electrically connect adjacent electrodes with each other. Lengths of the sub-section measured in the longitudinal direction of the substrate 610 are 26.7 mm. Resistance values of the sub-section of the heat generating element 620 with respect to the longitudinal direction are 120Ω. With such a structure, the heat generating element 620 is capable of generating heat in a partial area or areas with respect to the longitudinal direction.

The resistances of the heat generating elements 620 with respect to the longitudinal direction are uniform, and the heat generating elements 620*a*-620*l* have substantially the same dimensions. Therefore, the resistance values of the heat generating elements 620*a*-620*l* are substantially equal. When they are supplied with electric power in parallel, the heat generation distribution of the heat generating element 620 is uniform. However, it is not inevitable that the heat generating elements 620*a*-620*l* have substantially the same dimensions and/or substantially the same resistivities. For example, the resistance values of the heat generating elements 620*a* and 620*l* may be adjusted so as to prevent local temperature lowering at the longitudinal end portions of the heat generating element 620. At the positions of the heat generating element 620 where the common electrode 642 and the opposite electrode 652, 662 are provided, the heat generation of the heat generating element 620 is substantially zero. A problem that the heat generating element 620 is lowered in temperature at the electrode positions will be described hereinafter.

The common electrodes 642 (642*a*-642*g*) are a part of the above-described electroconductor pattern. The common electrode 642 extends in the widthwise direction of the substrate 610 perpendicular to the longitudinal direction of the heat generating element 620. In this embodiment, of the electroconductive pattern formed on the heater 600, only a region contacting the heat generating element 620 is called the electrode. In this embodiment, the common electrode 642 is laminated on the heat generating element 620. The common electrodes 642 are odd-numbered electrodes of the electrodes connected to the heat generating element 620, as counted from a one longitudinal end of the heat generating element 620. The common electrode 642 is connected to one contact 110*a* of the voltage source 110 through the common electroconductive line 640 which will be described hereinafter.

The opposite electrodes 652, 662 are a part of the above-described electroconductor pattern. The opposite electrodes 652, 662 extend in the widthwise direction of the substrate 610 perpendicular to the longitudinal direction of the heat generating element 620. The opposite electrodes 652, 662 are the other electrodes of the electrodes connected with the heat generating element 620 other than the above-described common electrode 642. That is, in this embodiment, they are even-numbered electrodes as counted from the one longitudinal end of the heat generating element 620.

That is, the common electrode 642 and the opposite electrodes 662, 652 are alternately arranged along the longitudinal direction of the heat generating element. The opposite electrodes 652, 662 are connected to the other contact 110*b* of the voltage source 110 through the opposite electroconductive lines 650, 660 which will be described hereinafter. The common electrode 642 and the opposite electrode 652, 662 function as electrode portions for supplying the electric power to the heat generating element 620. In this embodiment, the odd-numbered electrodes are common electrodes 642, and the even-numbered electrodes are opposite electrodes 652, 662, but the structure of the heater 600 is not limited to this example. For example, the even-numbered electrodes may be the common electrodes 642, and the odd-numbered electrodes may be the opposite electrodes 652, 662.

In addition, in this embodiment, four of the all opposite electrodes connected with the heat generating element 620 are the opposite electrode 652. In this embodiment, two of the all opposite electrodes connected with the heat generating element 620 are the opposite electrode 662. However, the allotment of the opposite electrodes is not limited to this example, but may be changed depending on the heat generation widths of the heater 600. For example, two may be the opposite electrode 652, and four maybe the opposite electrode 662.

The common electroconductive line 640 is a part of the above-described electroconductor pattern. The common electroconductive line 640 extends along the longitudinal direction of the substrate 610 toward the one end portion side 610*a* of the substrate in the one end portion side 610*d* of the substrate. The common electroconductive line 640 is connected with the common electrodes 642 (642*a*-642*g*) which is in turn connected with the heat generating element 620 (620*a*-620*l*). In this embodiment, the electroconductive patterns connecting the electrodes with the electrical contacts are all called the electroconductive lines. That is, also a region extending in the widthwise direction of the substrate 610 is a part of the electroconductive line. The common electroconductive line 640 is connected to the electrical contact 641 which will be described hereinafter. In this embodiment, in order to assure the insulation of the insulation coating layer 680, a gap of 400 μm is provided between the common electroconductive line 640 and each opposite electrode.

The opposite electroconductive line 650 is a part of the above-described electroconductor pattern. The opposite electroconductive line 650 extends along the longitudinal direction of substrate 610 toward the one end portion side 610*a* of the substrate in the other end portion side 610*e* of the substrate. The opposite electroconductive line 650 is connected with the opposite electrodes 652 (652*a*-652*d*) which are in turn connected with heat generating elements 620 (620*c*-620*j*). The opposite electroconductive line 650 is connected to the electrical contact 651 which will be described hereinafter.

The opposite electroconductive line 660 (660*a*, 660*b*) is a part of the above-described electroconductor pattern. The opposite electroconductive line 660*a* extends along the longitudinal direction of substrate 610 toward the one end portion side 610*a* of the substrate in the other end portion side 610*e* of the substrate. The opposite electroconductive line 660*a* is connected with the opposite electrode 662*a* which is in turn connected with the heat generating element 620 (620*a*, 620*b*). The opposite electroconductive line 660*a* is connected to the electrical contact 661*a* which will be described hereinafter. The opposite electroconductive line 660*b* extends along the longitudinal direction of substrate 610 toward the one end portion side 610*a* of the substrate in the other end portion side 610*e* of the substrate. The opposite electroconductive line 660*b* is connected with the opposite electrode 662*b* which is in turn connected with the heat generating element 620. The opposite electroconductive line 660*b* is connected to the electrical contact 661*b* which will be described hereinafter. In this embodiment, in order to assure the insulation of the insulation coating layer 680, a gap of 400 μm is provided between the opposite electroconductive line 660*a* and the common electrode 642. In addition, between the opposite electroconductive lines 660*a* and 650 and between the opposite electroconductive lines 660*b* and 650, gaps of 100 μm are provided.

The electrical contacts 641, 651, 661 (661*a*, 661*b*) as portions-to-be-energized are a part of the above-described electroconductor pattern. Each of the electrical contacts 641, 651, 661 preferably has an area of not less than 2.5 mm×2.5 mm in order to assure the reception of the electric power supply from the connector 700 as an energizing portion (electric power supplying portion) which will be described hereinafter. In this embodiment, the electrical contacts 641, 651, 661 has a length 3 mm measured in the longitudinal direction of the substrate 610 and a width of not less than 2.5 mm measured in the widthwise direction of the substrate 610. The electrical contacts 641, 651, 661*a*, 661*b* are disposed in the one end portion side 610*a* of the substrate beyond the heat generating element 620 with gaps of 4 mm in the longitudinal direction of the substrate 610. As shown in FIG. 8, no insulation coating layer 680 is provided at the positions of the electrical contacts 641, 651, 661*a*, 661*b* so that the electrical contacts are exposed. The electrical contacts 641, 651, 661*a*, 661*b* are exposed on a region 610*a* which is projected beyond an edge of the belt 603 with respect to the longitudinal direction of the substrate 610. Therefore, the electrical contacts 641, 651, 661*a*, 661*b* are contactable to the connector 700 to establish electrical connection therewith.

When voltage is applied between the electrical contact 641 and the electrical contact 651 through the connection between the heater 600 and the connector 700, a potential difference is produced between the common electrode 642 (642*b*-642*f*) and the opposite electrode 652 (652*a*-652*d*). Therefore, through the heat generating elements 620*c*, 620*d*, 620*e*, 620*f*, 620*g*, 620*h*, 620*i*, 620*j*, the currents flow along the longitudinal direction of the substrate 610, the directions of the currents through the adjacent heat generating elements being substantially opposite to each other. The heat generating elements 620*c*, 620*d*, 620*e*, 620*f*, 620*g*, 620*h*, 620*i* as a first heat generating element generate heat, respectively.

When voltage is applied between the electrical contact 641 and the electrical contact 661*a* through the connection between the heater 600 and the connector 700, a potential difference is produced between the common electrodes 642*a*, 642*b* and the opposite electrode 662*a*. Therefore, through the heat generating elements 620*a*, 620*b*, the currents flow along the longitudinal direction of the substrate 610, the directions of the currents through the adjacent heat generating elements being opposite to each other. The heat generating elements 620*a*, 620*b* as a second heat generating element adjacent the first heat generating element generate heat.

When voltage is applied between the electrical contact 641 and the electrical contact 661*b* through the connection between the heater 600 and the connector 700, a potential difference is produced between the common electrodes 642*f*, 642*g* and the opposite electrode 662*b* through the common electroconductive line 640 and the opposite electroconductive line 660*b*. Therefore, through the heat generating elements 620*k*, 620*l*, the currents flow along the longitudinal direction of the substrate 610, the directions of the currents through the adjacent heat generating elements being opposite to each other. By this, the heat generating elements 620*k*, 620*l* as a third heat generating element adjacent to the first heat generating element generate heat.

In this manner, a part of the heat generating elements 620 can be selectively energized.

Between the one end portion side 610*a* of the substrate and the other end portion side 610*c*, there is a middle region 610*b*. More particularly, in this embodiment, the region between the common electrode 642*a* and the electrical contact 651 is the middle region 610*b*. The middle region 610*b* is a marginal area for permitting mounting of the connector 700 to the heater 600 placed inside the belt 603. In this embodiment, the middle region is 26 mm. This is sufficiently larger than the distance required for insulating the common electrode 642*a* and the electrical contact from each other.

[Connector]

Figure 9:
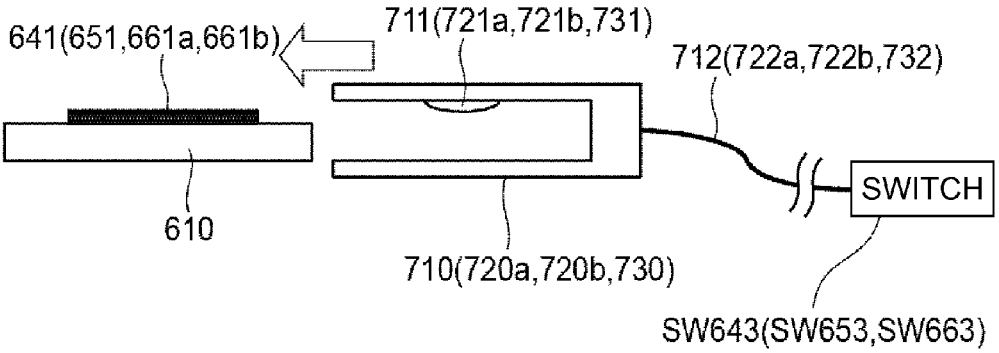
FIG. 9 illustrates a contact terminal.

The connector 700 used with the fixing device 40 will be described in detail. FIG. 9 is an illustration of a contact terminal 710. The connector 700 of this embodiment is electrically connected with the heater 600 by mounting to the heater 600. The connector 700 comprises a contact terminal 710 electrically connectable with the electrical contact 641, and a contact terminal 730 electrically connectable with the electrical contact 651. The connector 700 also comprises a contact terminal 720*a* electrically connectable with the electrical contact 661*a*, and a contact terminal 720*b* electrically connectable with the electrical contact 661*b*. Further, the connector 700 comprises a housing 750 for integrally holding the contact terminals 710, 720*a*, 720*b*, 730. The contact terminal 710 is connected with a switch SW643 by a cable. The contact terminal 720*a* is connected with a switch SW663 by a cable. The contact terminal 720*b* is connected with the switch SW663 by a cable. The contact terminal 730 is connected with a switch SW653 by a cable. The connector 700 sandwiches a region of the heater 600 extending out of the belt 603 so as not to contact with the belt 603, by which the contact terminals an electrically connected with the electrical contacts, respectively. In the fixing device 40 of this embodiment having the above-described structures, no soldering or the like is used for the electrical connection between the connectors and the electrical contacts. Therefore, the electrical connection between the heater 600 and the connector 700 which rise in temperature during the fixing process operation can be accomplished and maintained with high reliability. In the fixing device 40 of this embodiment, the connector 700 is detachably mountable relative to the heater 600, and therefore, the belt 603 and/or the heater 600 can be replaced without difficulty. The structure of the connector 700 will be described in detail.

As shown in FIG. 8, the connector 700 provided with the metal contact terminals 710, 720*a*, 720*b*, 730 is mounted to the heater 600 in the widthwise direction of the substrate 610 at one end portion side 610*a* of the substrate. The contact terminals 710, 720*a*, 720*b*, 730 will be described, taking the contact terminal 710 for instance. As shown in FIG. 9, the contact terminal 710 functions to electrically connect the electrical contact 641 to a switch SW643 which will be described hereinafter. The contact terminal 710 is provided with a cable 712 for the electrical connection between the switch SW643 and the electrical contact 711 for contacting to the electrical contact 641. The contact terminal 710 has a channel-like configuration, and by moving in the direction indicated by an arrow in FIG. 9, it can receive the heater 600. The portion of the contact terminal 710 which contacts the electrical contact 641 is provided with the electrical contact 711 which contacts the electrical contact 641, by which the electrical connection is established between the electrical contact 641 and the contact terminal 710. The electrical contact 711 has a leaf spring property, and therefore, contacts the electrical contact 641 while pressing against it. Therefore, the contact 710 sandwiches the heater 600 between the front and back sides to fix the position of the heater 600.

Similarly, the contact terminal 720*a* functions to contact the electrical contact 661*a* with the switch SW663 which will be described hereinafter. The contact terminal 720*a* is provided with the electrical contact 721*a* for connection to the electrical contact 661*a* and a cable 722*a* for connection to the switch SW663.

Similarly, the contact terminal 720*b* functions to contact the electrical contact 661*b* with the switch SW663 which will be described hereinafter. The contact terminal 720*b* is provided with the electrical contact 721*b* for connection to the electrical contact 661*b* and a cable 722*b* for connection to the switch SW663.

Similarly, the contact terminal 730 functions to contact the electrical contact 651 with the switch SW653 which will be described hereinafter. The contact terminal 730 is provided with the electrical contact 731 for connection to the electrical contact 651 and a cable 732 for connection to the switch SW653.

As shown in FIG. 8, the contact terminals 710, 720*a*, 720*b*, 730 of metal are integrally supported on the housing 750 of resin material. The contact terminals 710, 720*a*, 720*b*, 730 are provided in the housing 750 with spaces between adjacent ones so as to be connectable with the electrical contacts 641, 661*a*, 661*b*, 651, respectively when the connector 700 is mounted to the heater 600. Between adjacent contact terminals, partitions are provided to electrically insulate between the adjacent contact terminals.

In this embodiment, the connector 700 is mounted in the widthwise direction of the substrate 610, but this mounting method is not limiting to the present invention. For example, the structure may be such that the connector 700 is mounted in the longitudinal direction of the substrate.

[Electric Energy Supply to Heater]

An electric energy supply method to the heater 600 will be described. The fixing device 40 of this embodiment is capable of changing a width of the heat generating region of the heater 600 by controlling the electric energy supply to the heater 600 in accordance with the width size of the sheet P. With such a structure, the heat can be efficiently supplied to the sheet P. In the fixing device 40 of this embodiment, the sheet P is fed with the center of the sheet P aligned with the center of the fixing device 40, and therefore, the heat generating region extend from the center portion. The electric energy supply to the heater 600 will be described in conjunction with the accompanying drawings.

The voltage source 110 is a circuit for supplying the electric power to the heater 600. In this embodiment, the commercial voltage source (AC voltage source) of 100V in effective value (single phase AC) is used. The voltage source 110 of this embodiment is provided with a voltage source contact 110*a* and a voltage source contact 110*b* having different electric potential. The voltage source 110 may be DC voltage source if it has a function of supplying the electric power to the heater 600.

As shown in FIG. 5, the control circuit 100 is electrically connected with switch SW643, switch SW653, and switch SW663, respectively to control the switch SW643, switch SW653, and switch SW663, respectively.

Switch SW643 is a switch (relay) provided between the voltage source contact 110*a* and the electrical contact 641. The switch SW643 connects or disconnects between the voltage source contact 110*a* and the electrical contact 641 in accordance with the instructions from the control circuit 100. The switch SW653 is a switch provided between the voltage source contact 110*b* and the electrical contact 651. The switch SW653 connects or disconnects between the voltage source contact 110*b* and the electrical contact 651 in accordance with the instructions from the control circuit 100. The switch SW663 is a switch provided between the voltage source contact 110*b* and the electrical contact 661 (661*a*, 661*b*). The switch SW663 connects or disconnects between the voltage source contact 110*b* and the electrical contact 661 (661*a*, 661*b*) in accordance with the instructions from the control circuit 100.

When the control circuit 100 receives the execution instructions of a job, the control circuit 100 acquires the width size information of the sheet P to be subjected to the fixing process. In accordance with the width size information of the sheet P, a combination of ON/OFF of the switch SW643, switch SW653, switch SW663 is controlled so that the heat generation width of the heat generating element 620 fits the sheet P. At this time, the control circuit 100, the voltage source 110, switch SW643, switch SW653, switch SW663 and the connector 700 functions as an electric energy supplying means for supplying the electric power to the heater 600.

When the sheet P is a large size sheet (an introducible maximum width size as an example of a width size broader than a predetermined width size), that is, when A3 size sheet is fed in the longitudinal direction or when the A4 size is fed in the landscape fashion, the width of the sheet P is 297 mm. Therefore, the control circuit 100 controls the electric power supply to provide the heat generation width B (FIG. 5) of the heat generating element 620. To effect this, the control circuit 100 renders ON all of the switch SW643, switch SW653, switch SW663. As a result, the heater 600 is supplied with the electric power through the electrical contacts 641, 661*a*, 661*b*, 651, so that by energization through the electroconductive lines 640, 650, 660 as a first electroconductive line group, all of the 12 sub-sections of the heat generating element 620 generate heat. At this time, the heater 600 generates the heat uniformly over the 320 mm region to meet the 297 mm sheet P.

When the size of the sheet P is a small size (as an example of the predetermined width size), that is, when an A4 size sheet is fed longitudinally, or when an A5 size sheet is fed in the landscape fashion, the width of the sheet P is 210 mm. Therefore, the control circuit 100 provides a heat generation width A (FIG. 5) of the heat generating element 620. Therefore, the control circuit 100 renders ON the switch SW643, switch SW653 and renders OFF the switch SW663. As a result, the heater 600 is supplied with the electric power through the electrical contacts 641, 651, so that by energization through the electroconductive lines 640, 650 as a second electroconductive line group, only 8 sub-sections of the 12 heat generating element 620 generate heat. That is, in this embodiment, the electroconductive lines 640 and 650 function as both of the first electroconductive line group and the second electroconductive line group. At this time, the heater 600 generates the heat uniformly over the 213 mm region to meet the 210 mm sheet P. When the heater 600 effects the heat generation of the heat generation width A, a non-heat-generating region of the heater 600 is called a non-heat-generating portion C. When the heater 600 effects the heat generation of the heat generation width B, a non-heat-generating region of the heater 600 is called a non-heat-generating portion D.

[Relationship between Electroconductive Line and Electrode]

Figure 7:
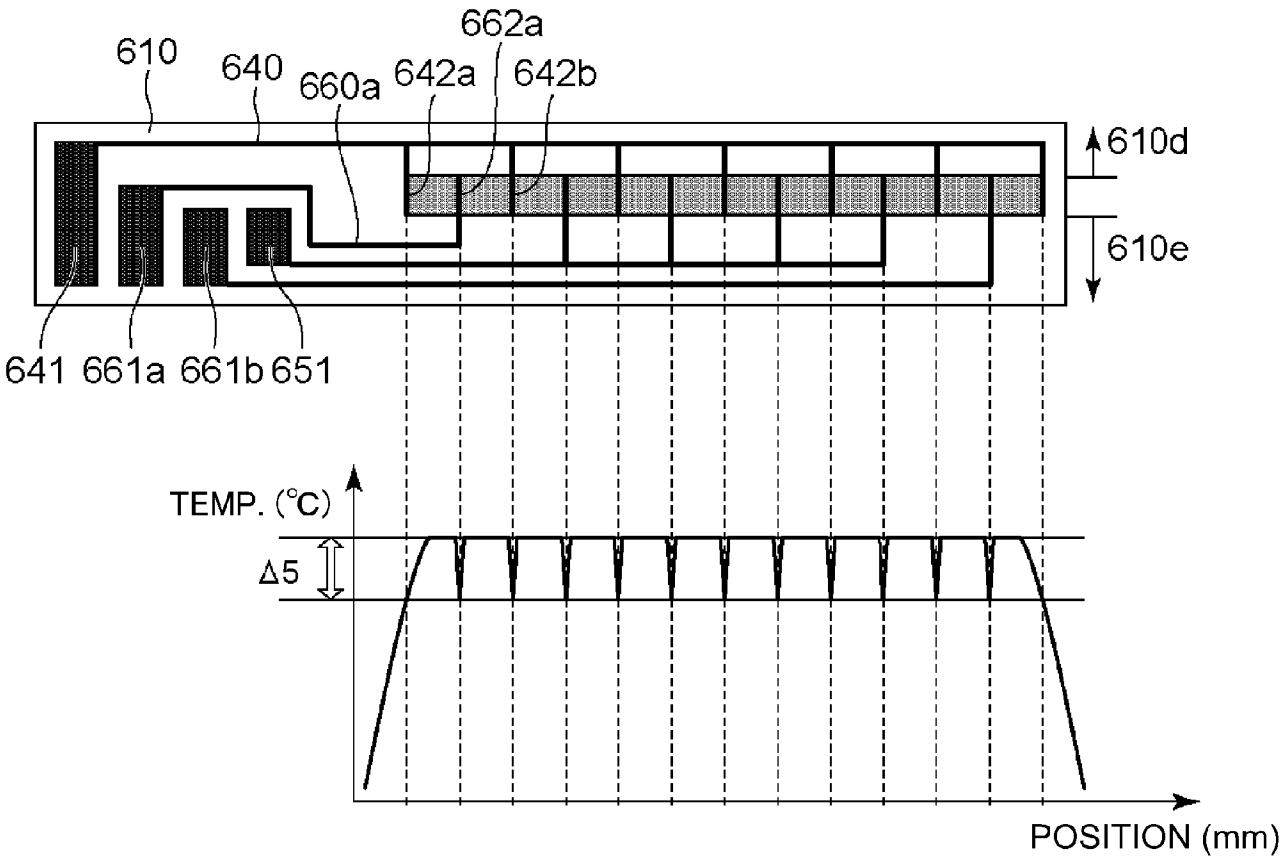
FIG. 7 illustrates a lowering in temperature at an electrode portion.

A relationship between the electroconductive lines 640, 650, 660 and the electrodes 642, 652, 662 which are described above will be described in detail. FIG. 7 is a schematic view for illustrating a lowering in temperature at the electrode portion. As in this embodiment, in the heater 600 of the type in which the plurality of electrodes are arranged in the longitudinal direction of the substrate 610 to energize the heat generating element, the lowering in temperature is locally generated at an electrode position. This is because the resistance of the electrode is small when compared with the resistance of the heat generating element 600 and therefore also the heat generation amount is small. In order to solve this problem, in this embodiment, the widths of the electrodes 642, 562, 662 are narrowed.

On the other hand, the electroconductive lines 640, 650, 660 formed as the electroconductive patterns by using the same material and step as those for the electrodes are capable of generating heat by the energization (electric power supply) independently of the width size of the sheet P. For that reason, there is a liability that the heat generation of the electroconductive lines does not contribute to the fixing process of the heater 600 to lead to waste of the electric power. For that reason, it is desirable that electric power consumption of the electroconductive lines is suppressed by lowering the resistance of the electroconductive lines. Particularly, at the non-heat-generating portion D where the heat generation by the heat generating element 620 is not made independently of the sheet width size, the heat generated by the electroconductive lines does not readily contribute the fixing process of the heater 600 and is liable to lead to the waste of the electric power. For that reason, the electroconductive lines 640, 650, 660 may desirably have a small electrical resistance at least at of the heater 600, the electroconductive line resistance is lowered by thickening the electroconductive lines 640, 650, 660. Accordingly, the electric power can be efficiently supplied to the heat generating element 620. An adjusting method of the electroconductive line resistance is not limited thereto. For example, the line thickness of the electroconductive lines 640, 650, 660 may also be increased to about 20 μm-30 μm. Adjustment of the electroconductive line thickness can be realized performing repetitive coating in screen printing. The electrodes are in a lamination positional resistance with the heat generating element, and therefore it is difficult to further increase the thickness of the electrodes. For that reason, in the case where the above method is used, the line thickness of the electroconductive lines 640, 650, 660 are thicker than the line thickness of the electrodes. However, from the viewpoint that the number of steps of the screen printing can be reduced, it is desirable that the constitution in this embodiment is employed. In the following description, a thick line width of the electroconductive line means that a cross-sectional area of the electroconductive line is large, and a narrow (thin) line width of the electrode means that a cross-sectional area of the electrode is small.

Description will be made in detail with reference to the drawings.

As described above, in the heater 600 in this embodiment, a high specific resistance material is used for the heat generating element 620, and a low specific resistance material is used for the electrodes 642, 652, 662. For that reason, at positions where the heat generating element 620 and the electrodes 642, 652, 662 overlap with each other, a current little flows into the heat generating element 620, and the heat generation amount of the electrodes 642, 652, 662 is also small, and therefore a temperature is lowered compared with a temperature at a peripheral portion. That is, the heater 600 does not have a flat temperature distribution with respect to the longitudinal direction. Here, measurement for checking a lowering in temperature at the electrode position was made.

In this measurement, the heater 600 including the electrodes 642, 652, 662 which have the same line width of 1 mm is used. Then, a voltage of 100 V is applied to this heater 600, and after a lapse of 1 sec., a temperature on the heat generating element is measured by a thermocamera ("T340" (trade name)), manufactured by FLIR Systems Inc. A measurement result is schematically shown in FIG. 7. In FIG. 7, the abscissa of the graph represents a longitudinal position of the heater 600, and the ordinate of the graph represents a temperature of the heater 600.

As shown in FIG. 7, with respect to the longitudinal direction of the heater 600 in places where the electrodes 642, 652, 662 are positioned, a local temperature lowering is observed. Specifically, the temperature measured at an intermediary position between the opposite electrode 662*a* and the common electroconductive 642*b* is 180° C., whereas the temperature measured at a position of each of the opposite electrode 662*a* and the common electrode 642*b* is 175° C. That is, at the position of each of the electrodes, compared with the peripheral portion, a temperature lowering of 5° C. was confirmed. When a similar measurement was made under a condition in which the line widths of the electroconductive lines 640, 650, 660 and the electrodes 642, 652, 662 were changed, it turned out that with a larger line width, a temperature lowering region enlarged and thus a lowering temperature became large.

Then, a test for checking the influence of this temperature lowering on the fixing process was conducted.

In this test, each of heaters 600 including the electrodes 642, 652, 662 different in line width was incorporated in the unit 60, and a solid black (Bk) image formed on the sheet P was fixed by the printer 1. As the sheet P, coated paper ("OKTOP128", manufactured by Oji Paper Co., Ltd., basis width: 128 g/m$^2$) was used. As the heaters 600, four types thereof in which the line width of the electrodes 624, 652, 662 is 0.1 mm, 0.5 mm, 1.0 mm and 1.5 mm were used.

Then, the image after the fixing process was observed with eyes, so that the presence or absence of uneven glossiness is discriminated. A result of evaluation of the uneven glossiness by visual observation is shown in Table 1 appearing hereinafter. In Table 1, a left column represents the electrode line width of the heater 600 subjected to the test. In Table 1, a center column represents an amount of the temperature lowering at the electrode when compared with the temperature at the peripheral portion. This temperature lowering amount was measured by the above-described measuring method. In Table 1, a right column represents a discrimination result of the presence or absence of the uneven glossiness. In the right column of Table 1, "o" represents that the uneven glossiness is not observed, and "x" represents that the uneven glossiness is observed.

TABLE 1

| EV*1 (mm) | TL*2 (° C.) | UG*3 |
|---|---|---|
| 0.1 | 0 | ○ |
| 0.5 | 2 | ○ |
| 1.0 | 5 | x |
| 1.5 | 9 | x |

*1"EW" represents the width of an associated one of the common electrode and the opposite electrode.
*2"TL" represents the temperature lowering at the electrode portion compared with the temperature at the peripheral portion.
*3"UG" represents the uneven glossiness.

As shown in Table 1, in the case where the electrode line width is 0.1 mm, the temperature lowering amount at the electrode is 0° C. This would be considered because the temperature lowering at the electrode is sufficiently replenished by heat conduction on the substrate 610. From the result of Table 1, it was understood that the uneven glossiness was not generated on the image when the electrode line width is 0.5 mm or less. Accordingly, the line width of each of the electrodes 642, 652, 662 may preferably be 0.5 mm or less, more preferably 0.1 mm or less.

Then, the electroconductive lines 640, 650, 660 will be described. As described above, the electroconductive lines 640, 650, 660 are formed in the same step as that for the electrodes 642, 652, 662 and therefore in a conventional constitution, the electroconductive lines 640, 650, 660 and the electrodes 642, 652, 662 have the same width. However, the electroconductive line formed with the material having the resistance is increased and decreased in resistance depending on the line width as shown by the following formula. That is, the resistance value of the electroconductive line becomes large with a narrower line width.

$$\text{Resistance } R=\rho\times L/(w\times t)$$

In the formula, ρ is a specific resistance, L is a line length, w is a line width, and t is a line thickness.

The line thickness t of each of the electroconductive lines 640, 650, 660 and the electrodes 642, 652, 662 is adjusted in a range of 5 μm-30 μm, and in this embodiment, the line thickness t is 10 μm. As an electroconductive line length L1 of the common electroconductive line 640, 360.3 mm which is a length of a path from the electrical contact 641 to the common electrode 642*g* is used. As an electroconductive line length L2 of the opposite electroconductive line 660*b*, 327.7 mm which is a length of a path from the electrical contact 661*b* to the opposite electrode 662*b*. As an electroconductive line length L3 of the opposite electroconductive line 650, 267.3 mm which is a length of a path from the electrical contact 651 to the opposite electrode 652*d* is used. As an electroconductive line length L4 of the opposite electroconductive line 660*a*, 67.7 mm which is a length of a path from the electrical contact 661*a* to the opposite electrode 662*a*. A specific resistance p of a silver paste used as a material for the electroconductive lines 640, 650, 660 and the electrodes 642, 652, 662 is 0.00002 Ω·mm.

Here, similarly as the electrode line width for which a good result was obtained in the above-described test, when the heater 600 is designed by setting the line width of the electroconductive lines 640, 650, 660 at 0.1 mm, the following result was obtained.

That is, in this heater 600, a resistance value R1 of the common electroconductive line 640 is 7.2 Ω, a resistance value R2 of the opposite electroconductive line 660*b* is 6.6 Ω, a resistance value R3 of the opposite electroconductive line 650 is 5.3Ω, and a resistance value R4 of the opposite electroconductive line 660*a* is 1.4 Ω. In the case where a voltage of 100 V is supplied to the heater 600 having such electroconductive line resistances to generate heat with the heat generation width B. The electric power consumption is 705 W. Of the electric power consumption, 506 W is the electric power consumption of the heat generating element 620, and the remaining one is the electric power consumption of the electroconductive lines. In this way, about 30% of the electric power consumption of the entirety of the heater 600 is the electric power consumption of the electroconductive lines and thus constitutes a non-negligible ratio. Different from the heat generating element 620 capable of controlling the heat generation width by the control circuit 100, it is difficult to control the heat generation width of the electroconductive lines by the control circuit 100. For that reason, when a ratio in which the heat generation of the electroconductive lines contributes to the heat generation of the heater 600 is large, there is a liability that a region intended to be caused to generate heat cannot be properly caused to generate heat. Further, there is a liability that a temperature non-uniformity or the like generates in such a heater 600 and has the influence on a quality of the fixing process. Accordingly, it is desirable that the ratio of the electric power consumption of the electroconductive lines to the electric power consumption of the entirety of the heater 600.

Of the electric power consumed by the electroconductive lines, about 30% is the electric power consumed at the non-heat-generating portion D. That is, about 10% of the electric power consumption of the heater 600 is used in the heat generation of the electroconductive lines at the non-heat-generating portion D. Similarly, in the case where the heater 600 is designed with the line width of 0.5 mm for the electroconductive lines 640, 650, 660 and is supplied with the voltage of 100 V, about 10% of the electric power consumption of the heater 600 is used by the electroconductive lines, and about 3% is used at the non-heat-generating portion.

Further, the heat generated by the electroconductive lines at the non-heat-generating portion D which is a longitudinal region, of the heat generating element 620, where the sheet P does not pass does not contribute to the fixing process, and therefore constitutions loss (waste) of energy (electric power). For that reason, in such a heater 600, an amount of the electric power consumption required for fixing the image T on the sheet P becomes large.

Accordingly, in the heater 600, the electroconductive lines 640, 650, 660 may desirably have a small resistance value at the non-heat-generating portion D to the possible extent. Accordingly, it is desirable that in the heater 600, the line width of the electroconductive lines 640, 650, 660 at least at the non-heat-generating portion D is made thicker (broader) than the line width of the electrodes. By forming the electroconductive patterns in such a manner, it is possible to suppress an increase in electric power consumption of the heater 600 during the fixing process while suppressing the longitudinal temperature non-uniformity of the heater 600. In this embodiment, the thickness of the electroconductive lines is made thick uniformly over the entire region. By employing such a constitution, the heater 600 in this embodiment is capable of suppressing the electric power consumption at the electroconductive lines compared with the case where the line width of the electroconductive lines 640, 650, 660 is made thick only in the region of the non-heat-generating portion D.

In this embodiment, the line width of the electrodes is 0.1 mm, whereas the line width of the electroconductive lines is 1.0 mm. Accordingly, a cross-sectional area of the electrodes is 1000 $\mu m^2$, whereas a cross-sectional area of the electroconductive lines is 10,000 $\mu m^2$. That is, the width of the electroconductive lines 640, 650, 660 at the non-heat-generating portion D (outside of the heat generating element 620 with respect to the longitudinal direction of the substrate) is thicker (larger) than the width of the electrodes 642*b*-642*f*, 652, 662 each positioned between adjacent heat generating elements. In other words, the cross-sectional area of the electroconductive lines 640, 650, 660 at the non-heat-generating portion D (outside of the heat generating element 620 with respect to the longitudinal direction of the substrate) is larger than the cross-sectional area of the electrodes 642*b*-642*f*, 652, 662 each positioned between adjacent heat generating elements.

A combination of the line widths of the electrodes and the electroconductive lines is not limited to that of the above values, but this embodiment is applicable when the electroconductive line width is larger than the electrode line width. Further, the electroconductive line width may desirably be not less than two times of the electrode line width, more desirably be not less than five times the electrode line width. In this embodiment, the electroconductive lines are provided so that the line width thereof is constant over the entire region, but depending on an error of formation of the electroconductive patterns, the electroconductive line width can partly thick and narrow within a range of 0.1 mm. However, when the line widths of the electroconductive lines are averaged at each of positions, a resultant value approaches a desired value, and therefore the resistance of the entire electroconductive line can be substantially made a desired value.

In this embodiment, the resistance of each of the electroconductive lines 640, 650, 660 is 0.8Ω or less, so that the consumption of the electric power at the electroconductive lines has been able to suppressed to a low level. Further, in this embodiment, the electric power consumption of the electroconductive lines at the non-heat-generating portion D has been able to be suppressed to 1% or less of that of the entirety of the heater 600.

As described above, according to this embodiment, the temperature lowering of the heat generating element 620 at the electrode positions can be suppressed. For that reason, the heat generating element 620 can be caused to generate heat uniformly with respect to the longitudinal direction thereof.

Further, according to this embodiment, the heat generating region of the heat generating element can be controlled properly. For that reason, a high-quality image can be outputted.

Further, according to this embodiment, it is possible to suppress waste of the electric power of the heater 600. That is, with less electric power consumption, the image T on the sheet P can be subjected to the fixing process.

In this embodiment, the electroconductive line width w is set at 1.0 mm, but the value of the line width w is not limited thereto. The resistance value of the electroconductive lines becomes small with an increasing line width, and therefore line width may also be set at 1.0 mm or more. However, in the case where the line width of the electroconductive line is intended to be made extremely thick, there is a liability that the electroconductive lines cannot be formed unless a dimension of the substrate 610 with respect to the widthwise direction is enlarged. When the widthwise dimension of the substrate 610 is enlarged, a cost of the heater 600 increases, and therefore in this embodiment, the line width was set at the above-described value.

Further, in this embodiment, the line widths w of the electroconductive lines 640, 650, 660 are set at the same value, but may also be appropriately changed depending on an amount of a current or the like flowing into the electroconductive lines.

Further, in this embodiment, the same material is used for the electrodes and the electroconductive lines, but the electrodes and the electroconductive lines may also be not necessarily formed of the same material. If values of the volume resistivity (specific resistance) of the electrodes and the electroconductive lines are substantially the same, the constitution of this embodiment can be applied even when different materials are used.

Figure 11:
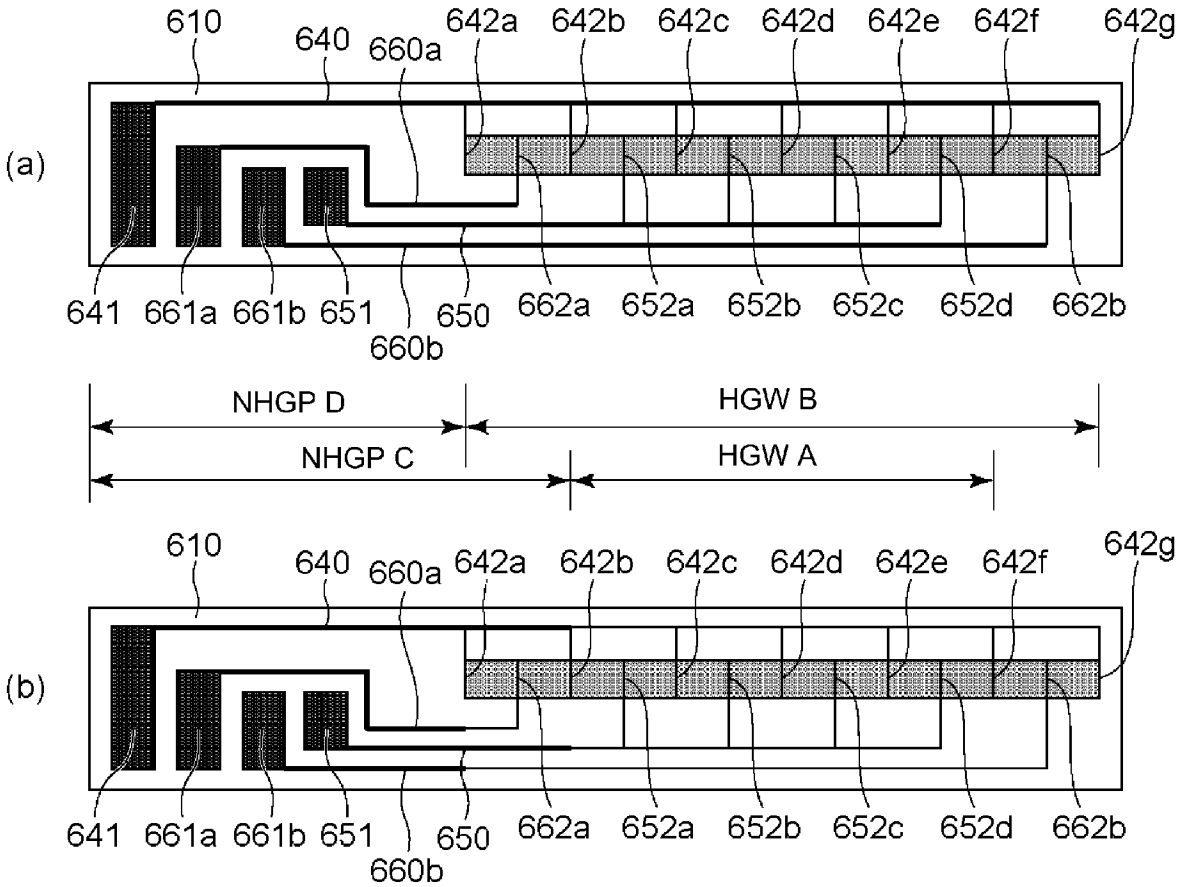
FIG. 11, each of (*a*) and (*b*) illustrates a structure of a heater in a modified example in Embodiment 2.

In FIG. 11, (*a*) and (*b*) are schematic structural views each showing a heater 600 in a modified example of this embodiment.

In this embodiment, the line width of the electroconductive lines is made thick in the entire region of the electroconductive lines, but the modified example in which the line width of the electroconductive lines is partly changed may also be used. For example, in a region extending from the electrodes along the widthwise direction, a narrow line width may also be set similarly as in the case of the electrodes in consideration of ease of electroconductive pattern formation or the like. That is, an electroconductive line constitution as in the modified embodiment shown in (*a*) of FIG. 11. In the other end portion side 610*c*, of the substrate, in which the electroconductive lines 640, 650, 660 oppose the plurality of heat generating elements, the width of the electroconductive lines 640, 650, 660 with respect to the widthwise direction of the substrate is larger than that of the electrodes 642*b*-642*f*, 652, 662. The current flowing into a region, of the electroconductive lines, extending from the electrodes along the widthwise direction is smaller than the current flowing into a region, of the electroconductive lines, extending along the longitudinal direction. For that reason, even in such a constitution, the electric power consumption can be sufficiently suppressed in the entirety of the electroconductive lines. However, from the viewpoint that the electric power consumption of the electroconductive lines can be suppressed to the possible extent, the constitution described in this embodiment may desirably be employed.

Further, a constitution in which only the line width of the electroconductive line positioned at the non-heat-generating portion of the heater 600 may also be employed. That is, an electroconductive line constitution as in the modified example shown in (*b*) of FIG. 11 may also be employed. Specifically, in the case where the heat generation width A is caused to generate heat, the line widths of the electroconductive lines 640 and 650 are made thick in the non-heat-generating portion D which is the region where the heat is not generated. Further, in the case where the heat generation width B is caused to generate heat, the line widths of the electroconductive lines 660*a* and 660*b* are made thick in the non-heat-generating portion C which is the region where the heat is not generated. At this time, an average of the line widths of the electroconductive lines is thicker than an average of the line widths of the electrodes. When such a constitution is employed, even in the case where the heater 600 is caused to generate heat with the heat generation width A, the heat generation of the electroconductive lines at the non-heat-generating portion C can be suppressed. Further, even in the case where the heater 600 is caused to generate heat with the heat generation width B, the heat generation of the electroconductive lines at the non-heat-generating portion D can be suppressed. For that reason, it is possible to sufficiently suppress the waste of the electric power at the non-heat-generating portions by the electroconductive lines. That is, the electroconductive line 650 connecting the electrodes 652*a*-652*d* with the electrical contact 651 in order to supply the electric power to the heat generating elements 620*c*-620*j*, and the electroconductive line 640 connecting the electrodes 642*a*-642*f* with the electrical contact 641 in order to supply the electric power to the heat generating elements 620*c*-620*j* are constituted as follows. That is, the width of the electroconductive lines 640, 650 in the non-heat-generating portion C (outside of the heat generating elements 620*c*-620*j* with respect to the longitudinal direction of the substrate) is larger than the width of the electrodes 632*b*-642*f*, 652, 662.

However, the heat generation by the electroconductive line is not readily used for the fixing process even in the region of the heat generation width B. Particularly, as in the case of the electroconductive line 660*b*, in the case where the electroconductive line is spaced from the heat generating element 620 in the widthwise direction of the substrate 610 (i.e., in the case where the electroconductive line is positioned at an end portion of the substrate 610 with respect to the widthwise direction of the substrate 610), the heat generation of the electroconductive line is not readily used for the fixing process. For that reason, there is a liability that the heat generation caused at the electroconductive line 660*b* leads to the waste of the electric power in the entire region of the substrate with respect to the longitudinal direction. For that reason, the constitution of this embodiment capable of further suppressing the waste of the electric power may desirably be employed.

Further, the heater 600 may also be not necessarily required that the line widths of all the electrodes are made thin. For example, as in the electrodes 642*a* and 642*g*, the electrodes, provided at longitudinal end portions, having no influence on the heat generation non-uniformity may also be provided thickly. However, in the case where the electrode is made thick unnecessarily, the substrate upsizes with respect to the longitudinal direction thereof, and thus leads to an increase in cost. For that reason, as in this embodiment, it is desirable that the line widths of all the electrodes are made thin.

[Embodiment 2]

A heater according to Embodiment 2 of the present invention will be described. FIG. 14 is an illustration of a structure relation of the fixing device 40 in this embodiment. In Embodiment 1, the line width of the electroconductive lines 640, 650, 660 is made thick uniformly compared with the line width of the electrodes. On the other hand, in Embodiment 2, the electroconductive lines 640, 650, 660 are provided so as to have different line widths from each other. Specifically, the line width is made thick with a longer length L of the electroconductive line. By employing such a constitution, even on the substrate having a limited length with respect to the widthwise direction, the resistance value of the electroconductive line can be lowered efficiently. Further, by adjusting the line widths so that the resistance values of the respective electroconductive lines are the same, values of the electric power supplied to the respective electroconductive lines can be uniformized, and therefore the heater can generate heat uniformly with respect to the longitudinal direction. That is, it is possible to suppress the heat generation non-uniformity of the heater 600 caused due to the lowering in voltage by the electroconductive lines. Embodiment 2 is constituted similarly as in Embodiment 1 except for the above-described difference. For that reason, the same reference numerals or symbols as in Embodiment 1 are assigned to the elements having the corresponding functions in this embodiment, and the detailed description thereof is omitted for simplicity.

Figure 10:
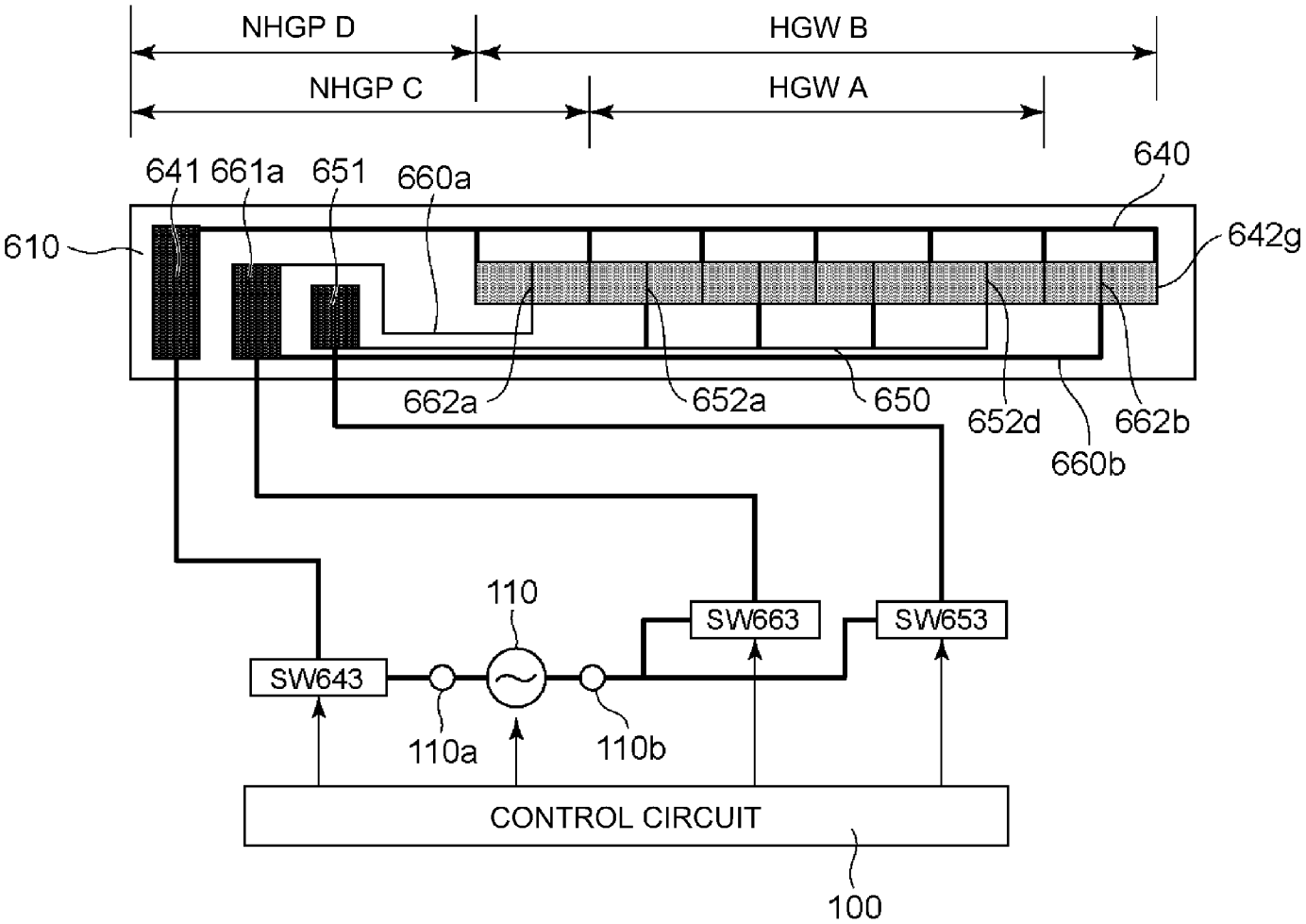
FIG. 10 illustrates a structural relationship of an image heating apparatus according to Embodiment 2.

As shown in FIG. 10, in the heater 600 of this embodiment, the heat generating element 620 is supplied with the electric power through the electrical contacts 641, 651, 661*a* provided in one end portion side of the substrate 610 with respect to the longitudinal direction.

The opposite electroconductive line 660*a* extends along the longitudinal direction of the substrate 610 toward the one end portion side 610*a* of the substrate in another end portion side with respect to the widthwise direction substrate 610 beyond the heat generating element 620. The end of the opposite electroconductive line 660*a* is connected with the electrical contact 661*a*. In the opposite electroconductive line 660*b* extends along the longitudinal direction of the substrate 610 toward the one end portion side 610*a* of the substrate in another end portion side with respect to the widthwise direction substrate 610 beyond the heat generating element 620. The end of the opposite electroconductive line 660*b* is connected with the electrical contact 661*a*. The opposite electroconductive lines 660*a* and 660*b* surrounds the electrical contact 651*a* in the one end portion side of the substrate 610 with respect to the longitudinal direction. With such a structure, the electrical contact 661*a* can function as both of the electrical contacts 661*b* and 661*a* of Embodiment 1.

Further, as shown in FIG. 10, a length of a path connecting the electrical contact (641, 651, 661*a*) with the heat generating element 620 is different depending on the associated one of the electroconductive lines. Specifically, the length of the path of the opposite electroconductive line 660*b* connecting the electrical contact 661*a* with the opposite electrode 662*b* is longer than the length of the path of the opposite electroconductive line 660*a* connecting the electrical contact 661*a* with the opposite electrode 662*a*. Further, the longer electroconductive line has a tendency to become large in resistance thereof. This is because the resistance value of the electroconductive line depends on the length L of the electroconductive line as shown in the following formula.

$$\text{Resistance } R=\rho\times L/(w\times t)$$

In the formula, ρ is a specific resistance, L is a line length, w is a line width, and t is a line thickness.

In the case where the resistance values of the electroconductive lines are different from each other, values of the electric power consumed by the electroconductive lines are different from each other, so that the heat generating element 620 causes a difference in electric power consumed thereby with respect to the longitudinal direction. Specifically, in the case where the resistance value of the electroconductive line 660*b* is larger than the resistance value of the electroconductive line 660*a*, the electric power supplied to the heat generating elements 620*j*, 620*l* becomes smaller than the electric power supplied to the heat generating elements 620*a*, 620*b*. For this reason, when the resistance values of the electroconductive lines are different from each other, there is a liability that a temperature distribution of the heat generating element 620 becomes non-uniform with respect to the longitudinal direction. Specifically, in the case where the resistance value of the electroconductive line 660*b* is larger than the resistance value of the electroconductive line 660*a*, there is a liability that a temperature of the heat generating elements 620*j*, 620*l* becomes lower than a temperature of the heat generating elements 620*a*, 620*b*. For that reason, it is desirable that the resistance values of the electroconductive lines are substantially the same. Particularly, it is desirable that the electroconductive lines 660*a*, 660*b* which are connected with the same electrical contact 661*a* and for which the number of the heat generating elements connected with the associated electroconductive line is also the same have the substantially same resistance value. Therefore, in this embodiment, the line width is made thick with a longer electroconductive line.

The line thickness t of each of the electroconductive lines 640, 650, 660 and the electrodes 642, 652, 662 is adjusted in a range of 5 μm-30 μm. In this embodiment, the line thickness t is 10 μm. As an electroconductive line length L1 of the common electroconductive line 640, 360.3 mm which is a length of a path from the electrical contact 641 to the common electrode 642*g* is used. As an electroconductive line length L2 of the opposite electroconductive line 660*b*, 327.7 mm which is a length of a path from the electrical contact 661*b* to the opposite electrode 662*b*. As an electroconductive line length L3 of the opposite electroconductive line 650, 267.3 mm which is a length of a path from the electrical contact 651 to the opposite electrode 652*d* is used. As an electroconductive line length L4 of the opposite electroconductive line 660*a*, 67.7 mm which is a length of a path from the electrical contact 661*a* to the opposite electrode 662*a*. A specific resistance p of a silver paste used as a material for the electroconductive lines 640, 650, 660 and the electrodes 642, 652, 662 is 0.00002 Ω·mm.

In this embodiment, the line width of the electrodes is 0.1 mm, and on the other hand, the line widths of the respective electroconductive lines are set as follows.

That is, the line width of the common electroconductive line 640 is 1.4 mm, the line width of the opposite electroconductive line 660*b* is 1.3 mm, the line width of the opposite electroconductive line 650 is 1.0 mm, and the line width of the opposite electroconductive line 660*a* is 0.2 mm.

By employing such a constitution, the resistance values of the respective electroconductive lines become a uniform value of 0.52Ω, so that the electric power supplied to the heat generating element 620 can be made substantially constant with respect to the longitudinal direction. For that reason, the heat generating element 600 can be caused to generate heat uniformly with respect to the longitudinal direction thereof.

As described above, according to this embodiment, the temperature lowering of the heat generating element 620 at the electrode positions can be suppressed. For that reason, the heat generating element 620 can be caused to generate heat uniformly with respect to the longitudinal direction thereof.

Further, according to this embodiment, the heat generating region of the heat generating element can be controlled properly. For that reason, a high-quality image can be outputted.

Further, according to this embodiment, it is possible to suppress waste of the electric power of the heater 600. That is, with less electric power consumption, the image T on the sheet P can be subjected to the fixing process.

Further, according to this embodiment, similar electric power can be supplied to each of the plurality of the heat generating elements. That is, the temperature non-uniformity of the heat generating element 620 with respect to the longitudinal direction can be suppressed.

In this embodiment, the electrical contact 661*a* is caused to function as both of the electrical contacts 661*b* and 661*a* of Embodiment 1, but as in Embodiment 1, the constitution in which the electrical contacts 661*b* and 661*a* are provided separately from each other may also be used. Further, the line widths of the electroconductive lines may also be changed depending on the electroconductive line lengths.

In FIG. 11, (*a*) and (*b*) are illustrations each showing a heater 600 in a modified example of this embodiment.

In this embodiment, the line width of the electroconductive lines is made thick over the entire region, but the modified example in which the electroconductive line width is partly changed may also be used. A electroconductive line constitution as in the modified example shown in each of (*a*) and (*b*) of FIG. 11 may also be employed.

Further, in this embodiment, the same material is used for the electrodes and the electroconductive lines, but the electrodes and the electroconductive lines may also be not necessarily formed of the same material. If values of the volume resistivity (specific resistance) of the electrodes and the electroconductive lines are substantially the same, the constitution of this embodiment can be applied even when different materials are used.

(Other Embodiments)

The present invention is not restricted to the specific dimensions in the foregoing embodiments. The dimensions may be changed properly by one skilled in the art depending on the situations. The embodiments may be modified in the concept of the present invention.

The heat generating region of the heater 600 is not limited to the above-described examples which are based on the sheets P are fed with the center thereof aligned with the center of the fixing device 40, but the sheets P may also be supplied on another sheet feeding basis of the fixing device 40. For that reason, e.g., in the case where the sheet feeding basis is an end(-line) feeding basis, the heat generating regions of the heater 600 may be modified so as to meet the case in which the sheets are supplied with one end thereof aligned with an end of the fixing device. More particularly, the heat generating elements corresponding to the heat generating region A are not heat generating elements 620*c*-620*j* but are heat generating elements 620*a*-620*e*. With such an arrangement, when the heat generating region is switched from that for a small size sheet to that for a large size sheet, the heat generating region does not expand at both of the opposite end portions, but expands at one of the opposite end portions. That is, the present invention is applicable when there are at least two heat generating elements which are independently capable of generating heat by electric power supply.

The number of patterns of the heat generating region of the heater 600 is not limited to two. For example, three or more patterns may be provided.

The forming method of the heat generating element 620 is not limited to those disclosed in Embodiments 1, 2. In Embodiment 1, the common electrode 642 and in the opposite electrodes 652, 662 are laminated on the heat generating element 620 extending in the longitudinal direction of the substrate 610. However, the electrodes are formed in the form of an array extending in the longitudinal direction of the substrate 610, and the heat generating elements 620*a*-620*l* may be formed between the adjacent electrodes.

The number of the electrical contacts limited to three or four. For example, five or more electrical contacts may also be provided depending on the number of heat generating patterns required for the fixing device.

Further, in the fixing device 40 in Embodiment 1, by the constitution in which all of the electrical contacts are disposed in one longitudinal end portion side of the substrate 610, the electric power is supplied from one end portion side to the heater 600, but the present invention is not limited to such a constitution. For example, a fixing device 40 having a constitution in which electrical contacts are disposed in a region extended from the other end of the substrate 610 and then the electric power is supplied to the heater 600 from both of the end portions (outside the heat generating element 620 with respect to the longitudinal direction) may also be used. That is, the heater 600 may be provided with a portion-to-be-energized at each of the end portions.

Figure 12:
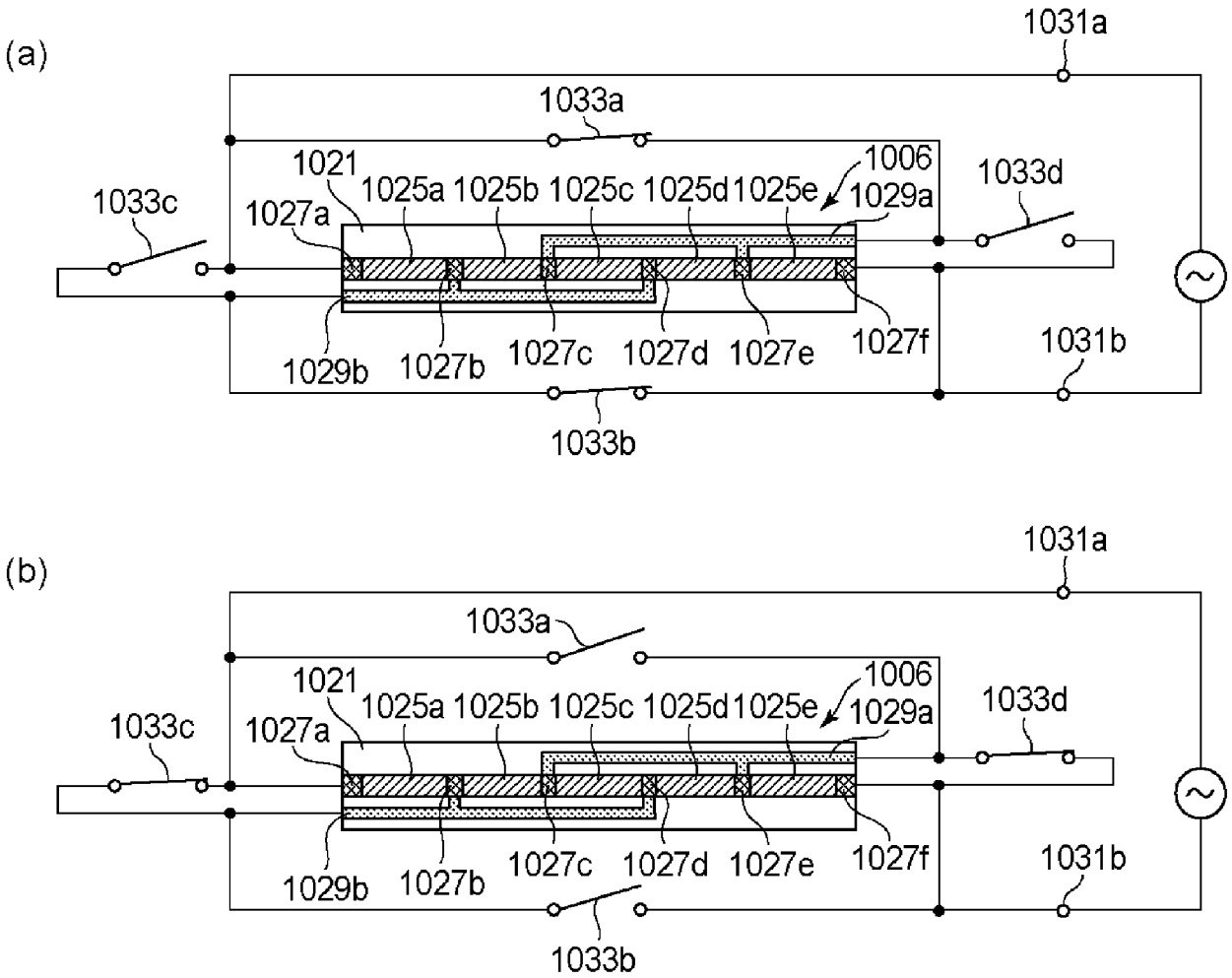
In FIG. 12, each of (*a*) and (*b*) is a circuit diagram of a conventional heater.

The arrangement constitution of the switches connecting the heater 600 with the power source 110 is not limited to that in Embodiment 1. For example, a switch constitution as in a conventional example shown in each of (*a*) and (*b*) of FIG. 12. That is, a polar (electric potential) relationship between the electrical contacts and power source contacts may be fixed or not fixed.

The belt 603 is not limited to that supported by the heater 600 at the inner surface thereof and driven by the roller 70. For example, so-called belt unit type in which the belt is extended around a plurality of rollers and is driven by one of the rollers. However, the structures of Embodiments 1-4 are preferable from the standpoint of low thermal capacity.

The member cooperative with the belt 603 to form of the nip N is not limited to the roller member such as a roller 70. For example, it may be a so-called pressing belt unit including a belt extended around a plurality of rollers.

The image forming apparatus which has been a printer 1 is not limited to that capable of forming a full-color, but it may be a monochromatic image forming apparatus. The image forming apparatus may be a copying machine, a facsimile machine, a multifunction machine having the function of them, or the like, for example, which are prepared by adding necessary device, equipment and casing structure.

The image heating apparatus is not limited to the apparatus for fixing a toner image on a sheet P. It may be a device for fixing a semi-fixed toner image into a completely fixed image, or a device for heating an already fixed image. Therefore, the fixing device 40 as the image heating apparatus may be a surface heating apparatus for adjusting a glossiness and/or surface property of the image, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-150779 filed on Jul. 24, 2014, which is hereby incorporated by reference herein in its entirety.

What is claimed is:

1. A heater connectable with an electric energy supplying portion having a first terminal and a second terminal, said heater comprising:

an elongate substrate;

a first electrical contact provided on said substrate and electrically connectable with the first terminal;

a plurality of second electrical contacts provided on said substrate and electrically connectable with the second terminal;

an electroconductive line extending in a longitudinal direction of said substrate and electrically connected with said first electrical contact;

a plurality of electrodes including first electrodes electrically connected with said first electrical contact through the electroconductive line and second electrodes electrically connected with said second electrical contacts, said first electrodes and said second electrodes being arranged alternately with predetermined gaps in the longitudinal direction; and a plurality of heat generating portions provided between adjacent ones of said electrodes so as to electrically connect between adjacent electrodes, said heat generating portions being capable of generating heat by electric power supplied between adjacent electrodes wherein a cross-sectional area of said electroconductive line outside said heat generating portions is larger than a cross-sectional area of an electrode, positioned between adjacent heat generating portions, of said electrodes.

2. A heater according to claim 1, wherein a line width of said electroconductive line outside said heat generating portions in the longitudinal direction is wider than a line width of said electrode, positioned between adjacent heat generating portions, of said electrodes.

3. A heater according to claim 1, wherein a cross-sectional area of said electroconductive line opposed to said heat generating portions in the longitudinal direction is larger than the cross-sectional area of said electrode, positioned between adjacent heat generating portions, of said electrodes.

4. A heater according to claim 3, wherein a line width of said electroconductive line opposed to said heat generating portions in the longitudinal direction is wider than a line width of said electrode, positioned between adjacent heat generating portions, of said electrodes.

5. A heater according to claim 1, further comprising:

a first electroconductive line provided on said substrate and configured to electrically connect between one of said second electrical contacts and a part of said second electrodes; and second electroconductive line provided on said substrate and configured to electrically connect between another one of said second electrical contacts and another part of said second electrodes.

6. A heater according to claim 5, wherein a cross-sectional area of said first electroconductive outside said heat generating portions in the longitudinal direction is larger than the cross-sectional area of said electrode, positioned between adjacent heat generating portions, of said electrodes.

7. A heater according to claim 6, wherein a line width of said first electroconductive line outside said heat generating portions in the longitudinal direction is wider than a line width of said electrode, positioned between adjacent heat generating portions, of said electrodes.

8. A heater according to claim 5, wherein a cross-sectional area of said second electroconductive line outside said heat generating portions in the longitudinal direction is larger than the cross-sectional area of said electrode, positioned between adjacent heat generating portions, of said electrodes.

9. A heater according to claim 8, wherein a line width of said second electroconductive line outside said heat generating portions in the longitudinal direction is wider than a line width of said electrode, positioned between adjacent heat generating portions, of said electrodes.

10. A heater according to claim 1, wherein said electroconductive line and said electrodes are made of the same material.

11. A heater according to claim 1, wherein said first electrical contact and said second electrical contacts are all disposed in one end portion side of said substrate with respect to the longitudinal direction.

12. An image heating apparatus comprising:

(i) an electric energy supplying portion provided with a first terminal and a second terminal;

(ii) a rotatable member configured to heat an image on a sheet; and (iii) a heater configured to heat said rotatable member, said heater including:

(iii-i) an elongate substrate;

(iii-ii) a first electrical contact provided on said substrate and electrically connectable with the first terminal;

(iii-iii) a plurality of second electrical contacts provided on said substrate and electrically connectable with the second terminal;

(iii-iv) an electroconductive line extending in a longitudinal direction of said substrate and electrically connected with said first electrical contact;

(iii-v) a plurality of electrodes including first electrodes electrically connected with said first electrical contact through the electroconductive line and second electrodes electrically connected with said second electrical contacts, said first electrodes and said second electrodes being arranged alternately with predetermined gaps in the longitudinal direction; and (iii-vi) a plurality of heat generating portions provided between adjacent ones of said electrodes so as to electrically connect between adjacent electrodes, said heat generating portions being capable of generating heat by electric power supplied between adjacent electrodes, wherein a cross-sectional area of said electroconductive line outside said heat generating portions in the longitudinal direction is larger than a cross-sectional area of an electrode, positioned between adjacent heat generating portions, of said electrodes.

13. An image heating apparatus according to claim 12, wherein a line width of said electroconductive line outside said heat generating portions in the longitudinal direction is wider than a line width of said electrode, positioned between adjacent heat generating portions, of said electrodes.

14. An image heating apparatus according to claim 12, wherein a cross-sectional area of said electroconductive line opposed to said heat generating portions in the longitudinal direction is larger than the cross-sectional area of electrode, positioned between adjacent heat generating portions, of said electrodes.

15. An image heating apparatus according to claim 14, wherein a line width of said electroconductive line opposed to said heat generating portions in the longitudinal direction is wider than a line width of said electrode, positioned between adjacent heat generating portions, of said electrodes.

16. An image heating apparatus according to claim 12, wherein said heater further comprises:

a first electroconductive line provided on said substrate and configured to electrically connect between one of said second electrical contacts and a part of said second electrodes; and a second electroconductive line provided on said substrate and configured to electrically connect between another one of said second electrical contacts and another part of said second electrodes.

17. An image heating apparatus according to claim 16, wherein a cross-sectional area of said first electroconductive line outside said heat generating portion in the longitudinal direction is larger than the cross-sectional area of said electrode, positioned between adjacent heat generating portions, of said electrodes.

18. An image heating apparatus according to claim 17, wherein a line width of said first electroconductive line outside said heat generating portions in the longitudinal direction is wider than a line width of said electrode, positioned between adjacent heat generating portions, of said electrodes.

19. An image heating apparatus according to claim 16, wherein a cross-sectional area of said second electroconductive line outside said heat generating portions in the longitudinal direction is larger than the cross-sectional area of said electrode, positioned between adjacent heat generating portions, of said electrodes.

20. An image heating apparatus according to claim 19, wherein a line width of said second electroconductive line outside said heat generating portions in the longitudinal direction is wider than a line width of said electrode, positioned between adjacent heat generating portions, of said electrodes.

21. An image heating apparatus according to claim 12, wherein said electroconductive line and said electrodes are made of the same material.

22. An image heating apparatus according to claim 12, wherein said first electrical contact and said second electrical contacts are all disposed in one end portion side of said substrate with respect to the longitudinal direction.

23. An image heating apparatus according to claim 12, wherein said electric energy supplying portion includes an AC circuit.

* * * * *